United States Patent [19]

Yokota

[11] 3,993,106

[45] Nov. 23, 1976

[54] WIRE SPRING-MANUFACTURING APPARATUS

[75] Inventor: Masayuki Yokota, Hachioji, Japan

[73] Assignee: France Bed Co., Ltd., Tokyo, Japan

[22] Filed: Oct. 25, 1974

[21] Appl. No.: 517,908

[30] Foreign Application Priority Data

| | | |
|---|---|---|
| Oct. 31, 1973 | Japan | 48-122339 |
| Mar. 8, 1974 | Japan | 49-26202 |
| Aug. 27, 1974 | Japan | 49-98259 |

[52] U.S. Cl. ..... 140/71 R; 140/103; 140/105

[51] Int. Cl.[2] ..... B21F 3/00; B21F 35/00; B21F 45/00

[58] Field of Search ..... 72/7, 298, 307, 342, 72/306; 140/71 R, 102, 103, 105; 148/150, 154; 219/7.5, 153

[56] References Cited

UNITED STATES PATENTS

| | | | |
|---|---|---|---|
| 904,563 | 11/1908 | Rau | 140/71 R |
| 2,261,878 | 11/1941 | Hathaway | 148/154 |
| 2,770,262 | 11/1956 | Gauci | 140/71 R |
| 3,195,583 | 7/1965 | Jones | 140/102 |
| 3,196,906 | 7/1965 | Sjobohm et al. | 140/71 R |
| 3,227,195 | 1/1966 | Stegmann | 140/103 |
| 3,493,016 | 2/1970 | Ott | 140/71 R |
| 3,556,166 | 1/1971 | Whitney | 140/105 |
| 3,672,410 | 6/1972 | Scheckel | 140/103 |
| 3,872,896 | 3/1975 | Yoshimura | 140/71 R |
| R27,021 | 1/1971 | Ott | 140/71 R |

FOREIGN PATENTS OR APPLICATIONS

| | | | |
|---|---|---|---|
| 770,104 | 3/1957 | United Kingdom | 140/71 R |

*Primary Examiner*—C. W. Lanham
*Assistant Examiner*—E. M. Combs

[57] ABSTRACT

A wire spring-manufacturing apparatus which comprises a wire feeder; a device for clamping a straight wire of prescribed length delivered from the wire feeder substantially at the center and intermittently rotating said wire about its axis; and a pair of wire-bending devices so disposed as to intermittently approach each other toward the wire-rotating device relative to the rotation of said wire, thereby successively bending both end portions of said wire to form spring legs.

12 Claims, 38 Drawing Figures

"ON" SIGNAL (265)
SIGNAL INFORMING THE COMPLETION OF WIRE BENDING
SIGNAL INFORMING THE COMPLETION OF SPRING LEGS-FORMING OPERATION
INPUT
OUTPUT
"ON" SIGNAL (265)
SIGNAL INFORMING THE COMPLETION OF WIRE BENDING
250
253
265
267
268
271
272
273
274
275
276
277
206
209
210
211
212
213
214
215
216
217
222

WIRE SPRING-MANUFACTURING APPARATUS

This invention relates to an apparatus for manufacturing wire springs which bends both end portions of a straight wire into spring legs each having a polygonal cross section and hanging at right angles to the straight portion thereof.

Hitherto, a mattress comprises a spring member built of a horizontal assembly of a plurality of coil springs connected by helical wires and frames.

However, such type of spring member has the drawbacks that it has a low elasticity and, when used as a bottom mattress, it prominently sags under a load and is ready to be shaken sidewise, thus failing to provide full stability. In place of said coil springs, therefore, there has been developed a mattress consisting of wire springs. In this case, the wire springs include a main wire spring and an intermediate support wire spring. The main wire spring is formed, as shown in FIGS 1 and 2, by bending both end portions of a long straight wire 11 into spring legs 12 each having a rectangular cross section and hanging at right angles to the straight portion of said wire. The intermediate support wire spring is provided at both ends with spring legs 14 formed like the main wire spring, but consists, as shown in FIGS. 3 and 4, of a shorter straight wire 13. Each vertically hanging intermediate support wire spring leg 14 takes an oblique position in a horizontal plane relative to the axis of the straight wire 13. When the main wire springs and intermediate support wire springs are combined to constitute a mattress spring member, a plurality of main wire springs are assembled in the lattice form and the intermediate support wire springs are fitted, as shown in FIG. 5, to the junctions of the straight portions of the main wire springs to connect the longitudinal and lateral main wire springs. A mattress comprising the above-mentioned spring member has a higher elasticity and is less subject to crosswise shaking than the prior art coil spring type mattress.

The fabrication of the main wire spring and intermediate support wire spring has hitherto been effected by bending both end portions of a straight wire in zigzags in a horizontal plane and further vertically folding said zigzag portion to form a spring leg. However, this manufacturing process bends the same spot of a straight wire several times, considerably losing the elasticity of the resultant spring.

This invention has been accomplished in view of the above-mentioned circumstances, and is intended to provide a wire spring-manufacturing apparatus which produces a high quality wire spring of prominent elasticity by successively bending a straight wire in a horizontal direction starting with both ends thereof toward the center while rotating the wire about its axis and setting each turn of the bent portion at a prescribed angle to a horizontal plane including the straight portion of said wire, thereby constructing a spring leg having a polygonal cross section at both ends of said wire, and in consequence requiring the different spots of each turn of the spring leg to be bent only once, and further, where necessary, can continuously carry out the entire process of feeding a straight wire, fabricating a spring leg, heat-treating the spring legs and applying rustproof wax thereto.

Namely, this invention provides a wire spring-manufacturing apparatus which comprises a wire feeder; a device for clamping a straight wire of prescribed length delivered from the wire feeder substantially at the center and intermittently rotating said wire about its axis; a pair of wire-bending devices so disposed as to intermittently approach said wire-rotating device relative to the rotation of said wire successively to bend both end portions thereof to construct spring legs; and a device for heat-treating the spring legs thus constructed.

This invention can be more fully understood from the following detailed description when taken in conjunction with the accompanying drawings, in which.

Figure 1:
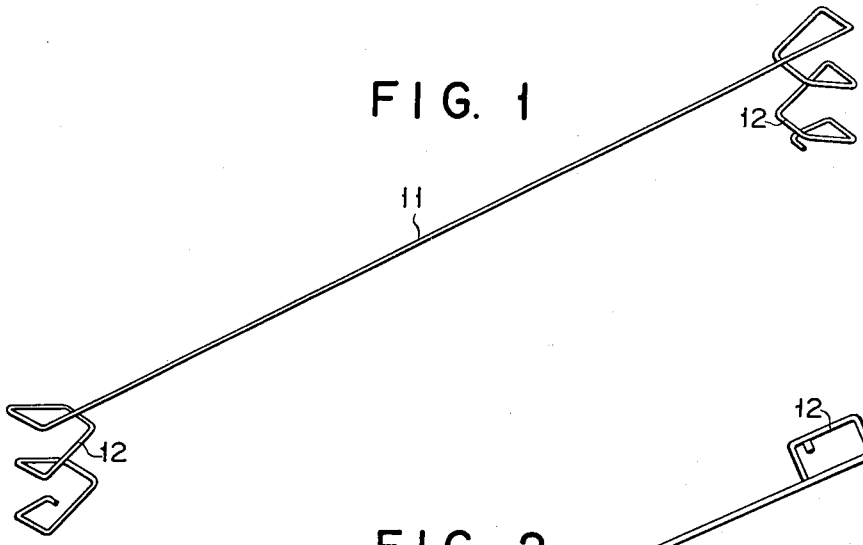
FIG. 1 is an oblique view of a main wire spring.
Figure 2:
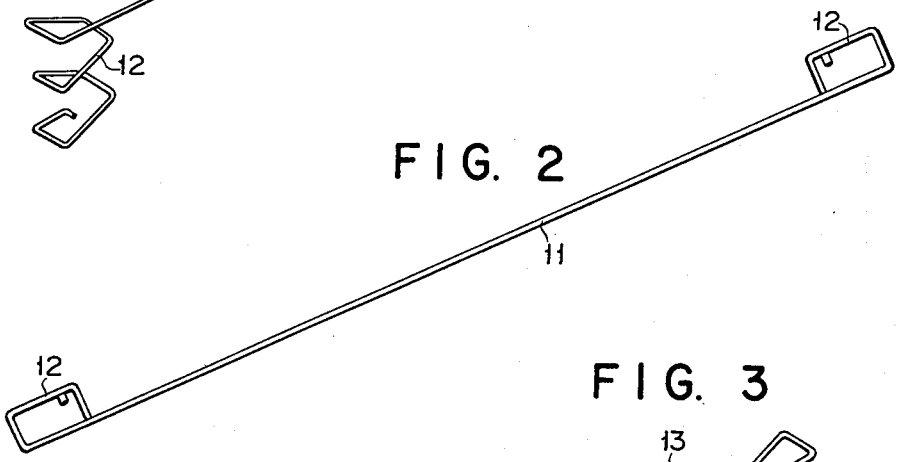
FIG. 2 is a plan view of the main wire spring of FIG. 1.
Figure 3:
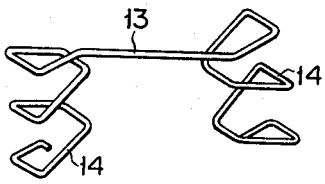
FIG. 3 is an oblique view of an intermediate support wire spring.
Figure 5:
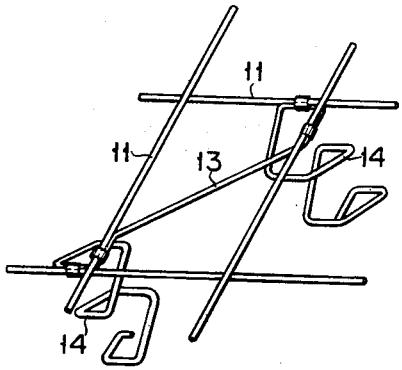
FIG. 5 is an oblique view of the main wire spring coupled with the intermediate support wire spring.
Figure 4:
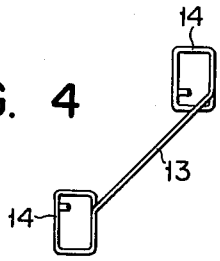
FIG. 4 is a plan view of the intermediate support wire spring.
Figure 6A:
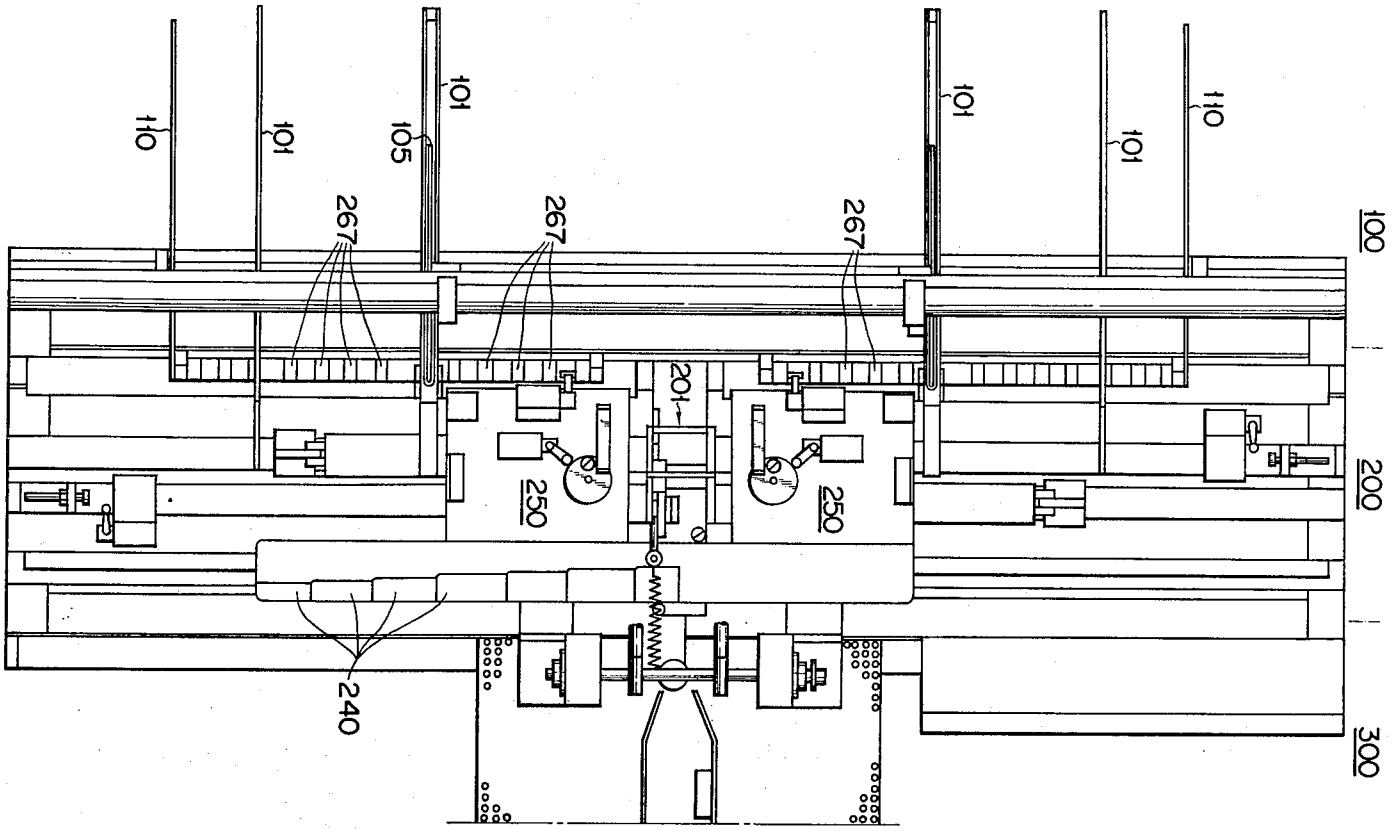
Figure 6B:
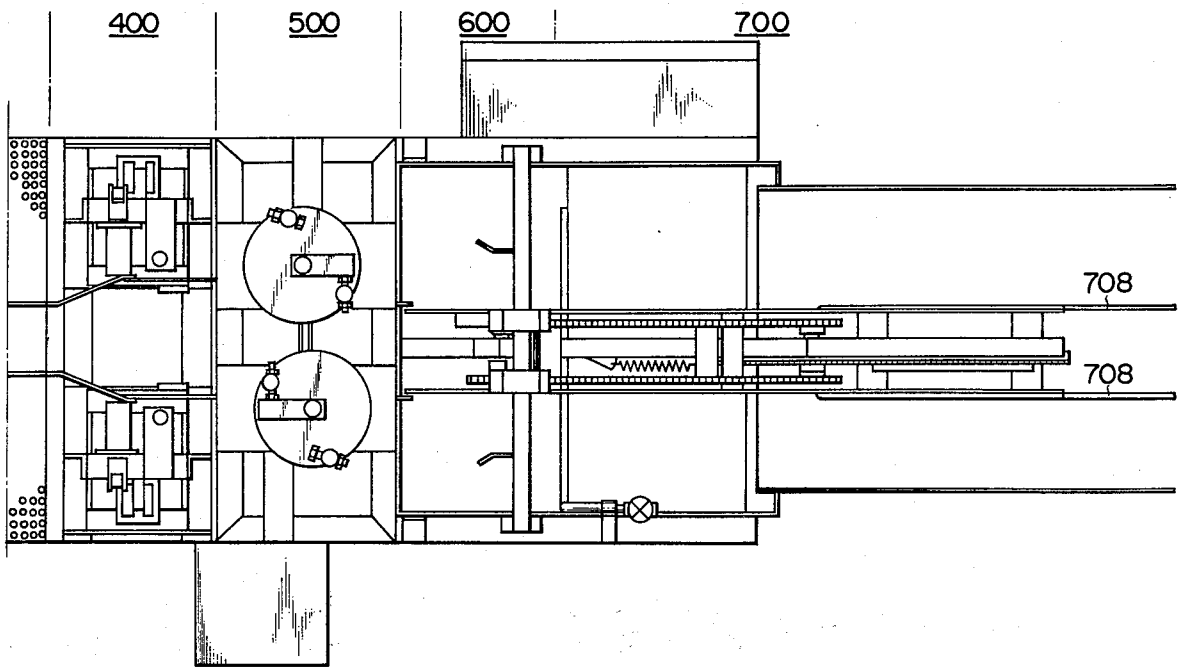
Figure 7:
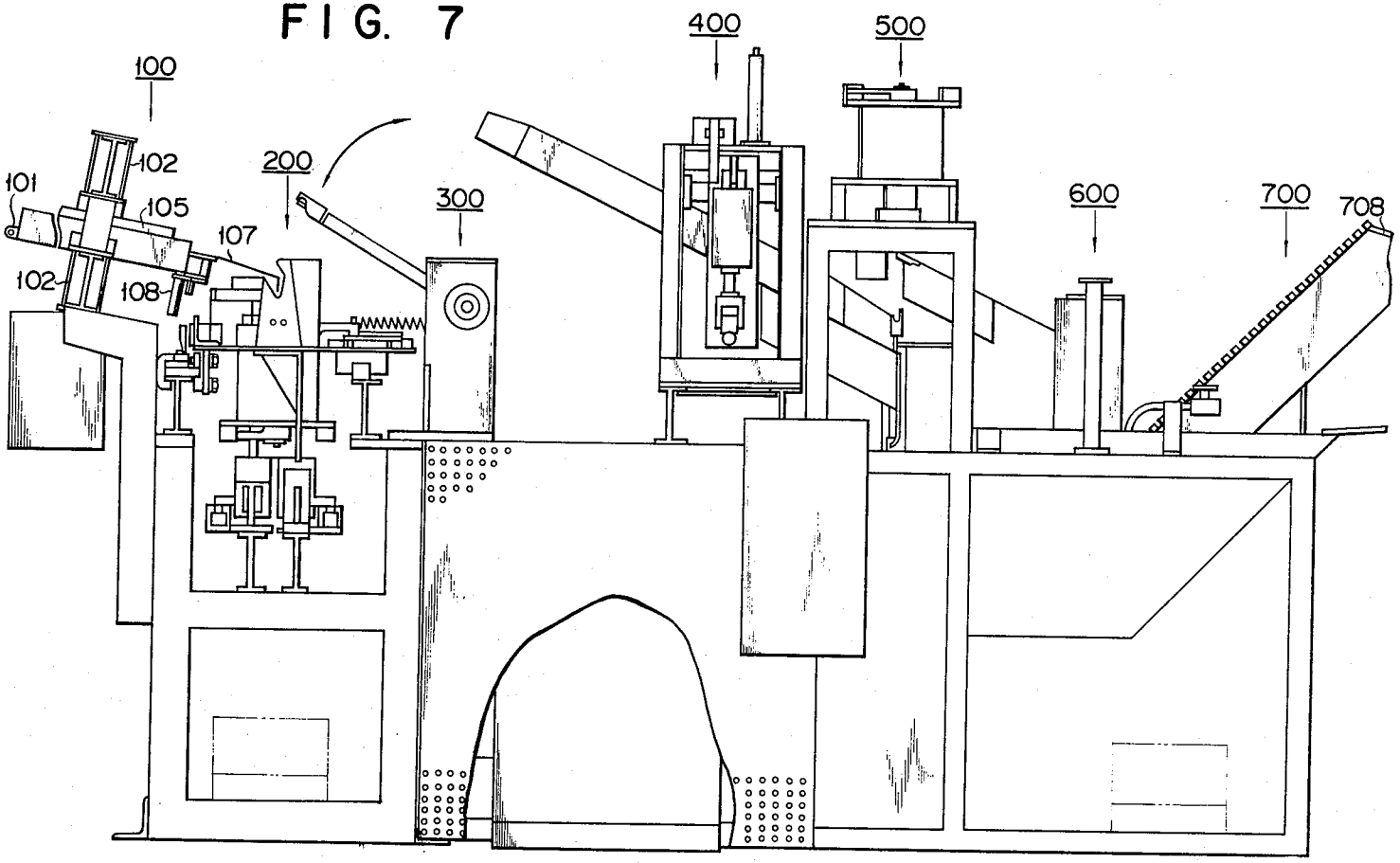
Figure 8:
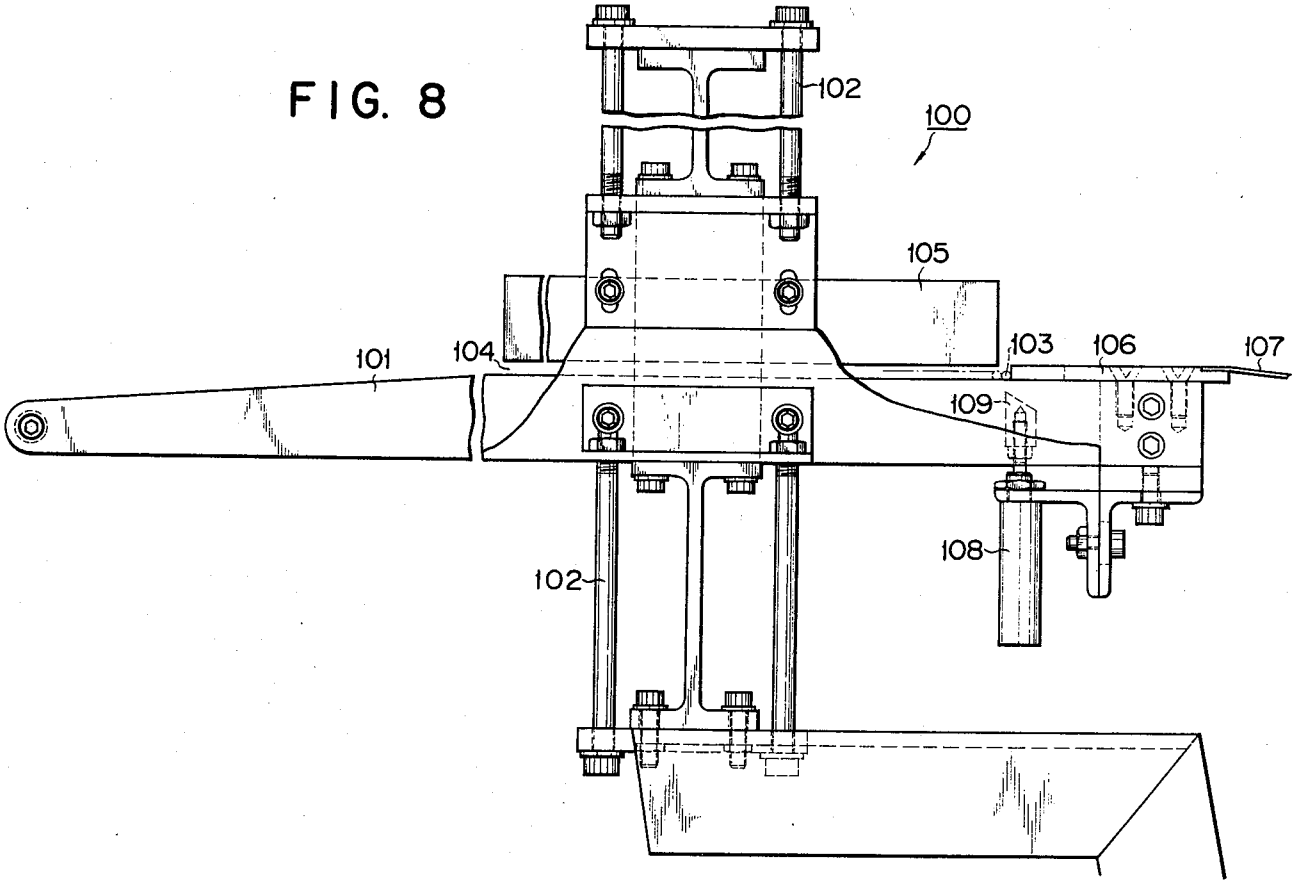
Figure 9:
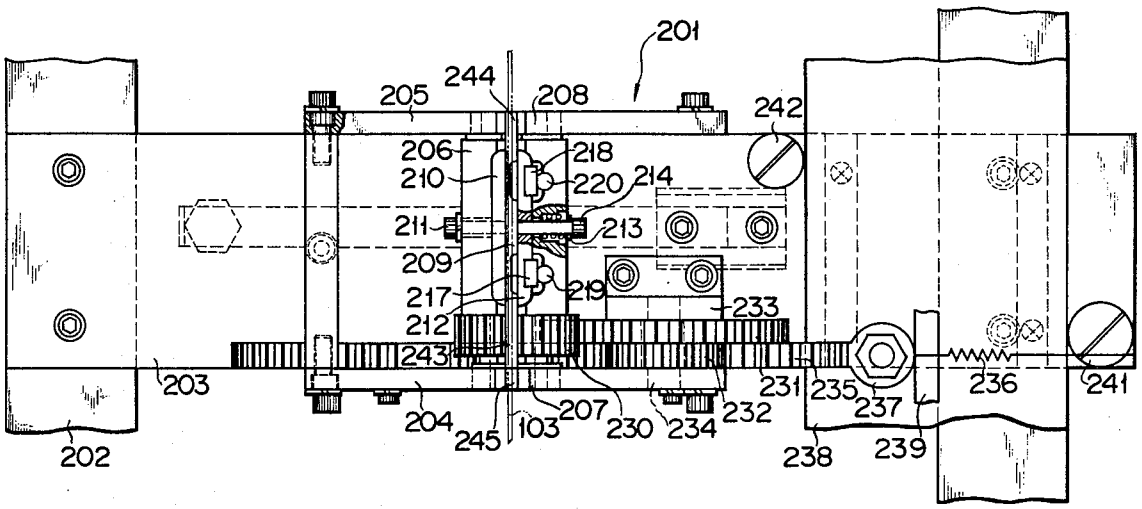
Figure 10:
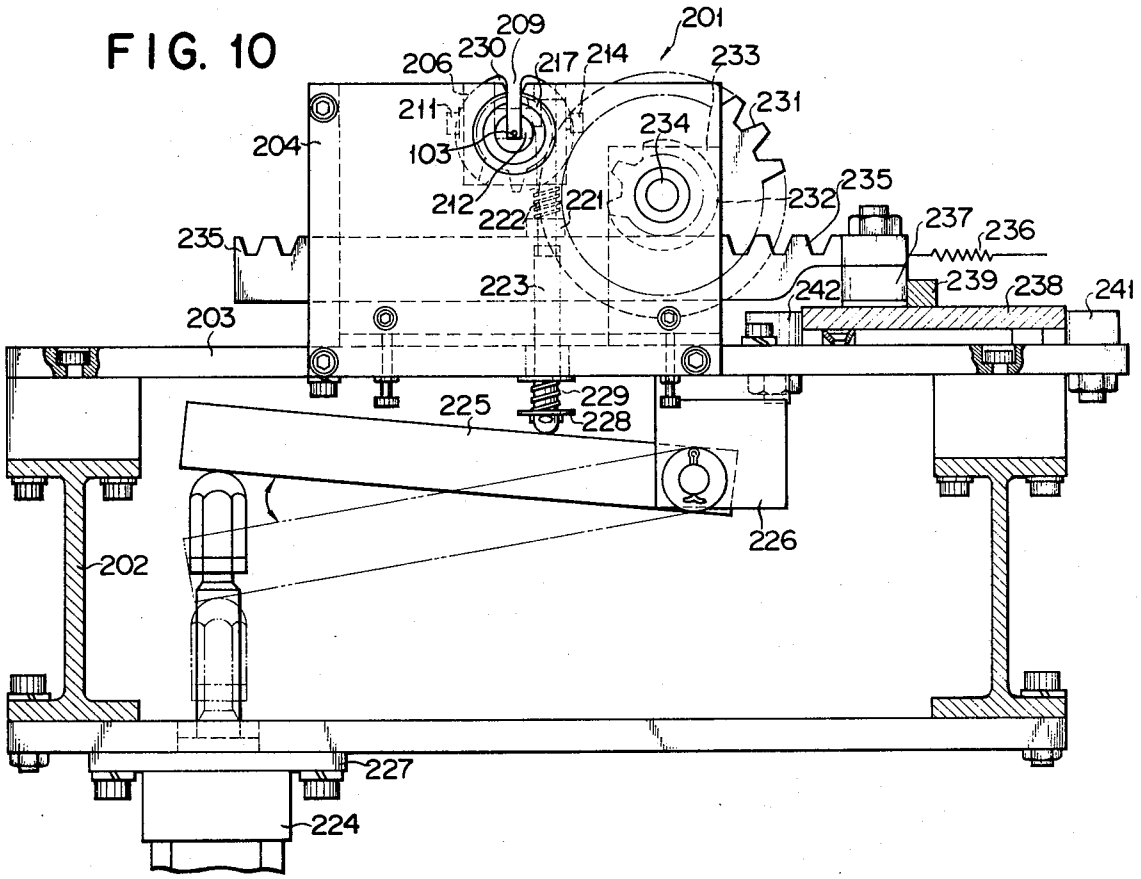
Figure 12:
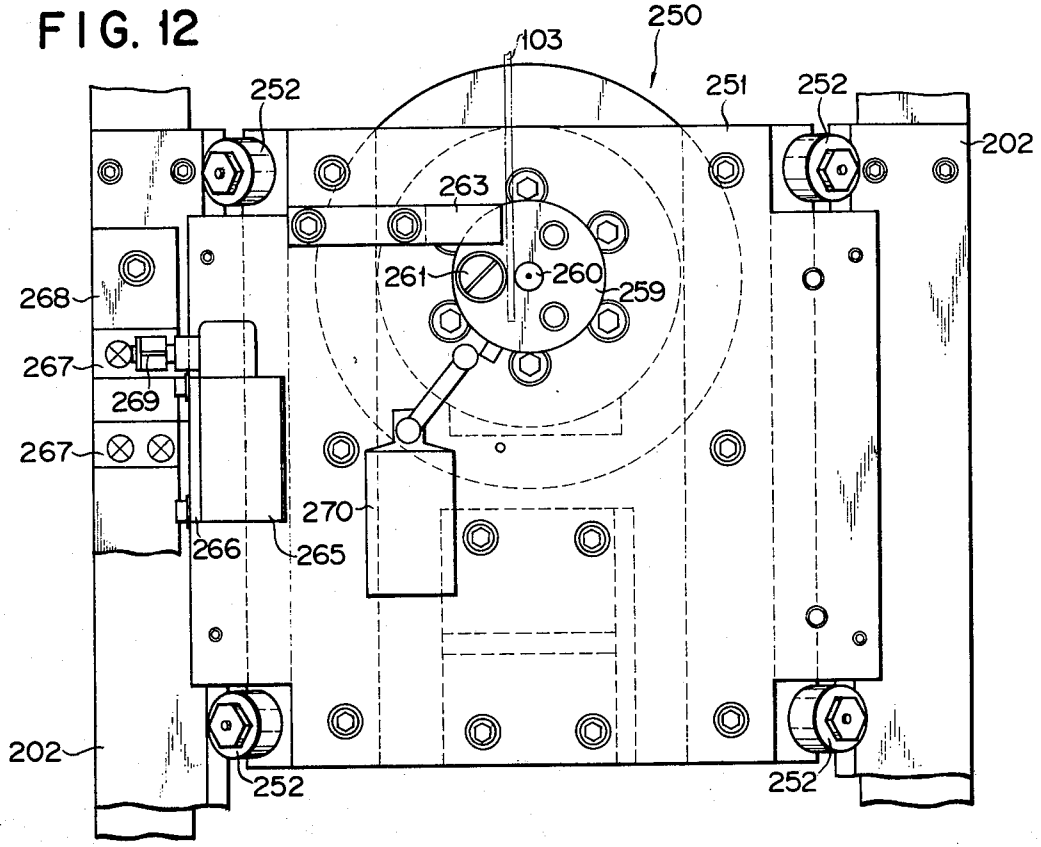
Figure 13:
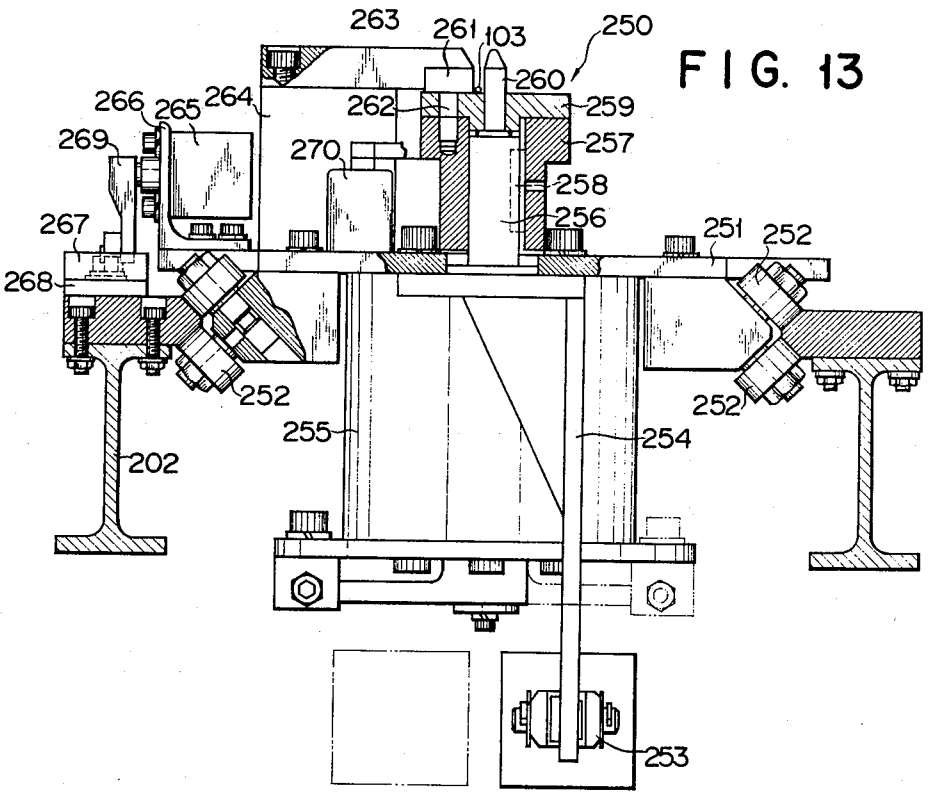
Figures 11, 14:
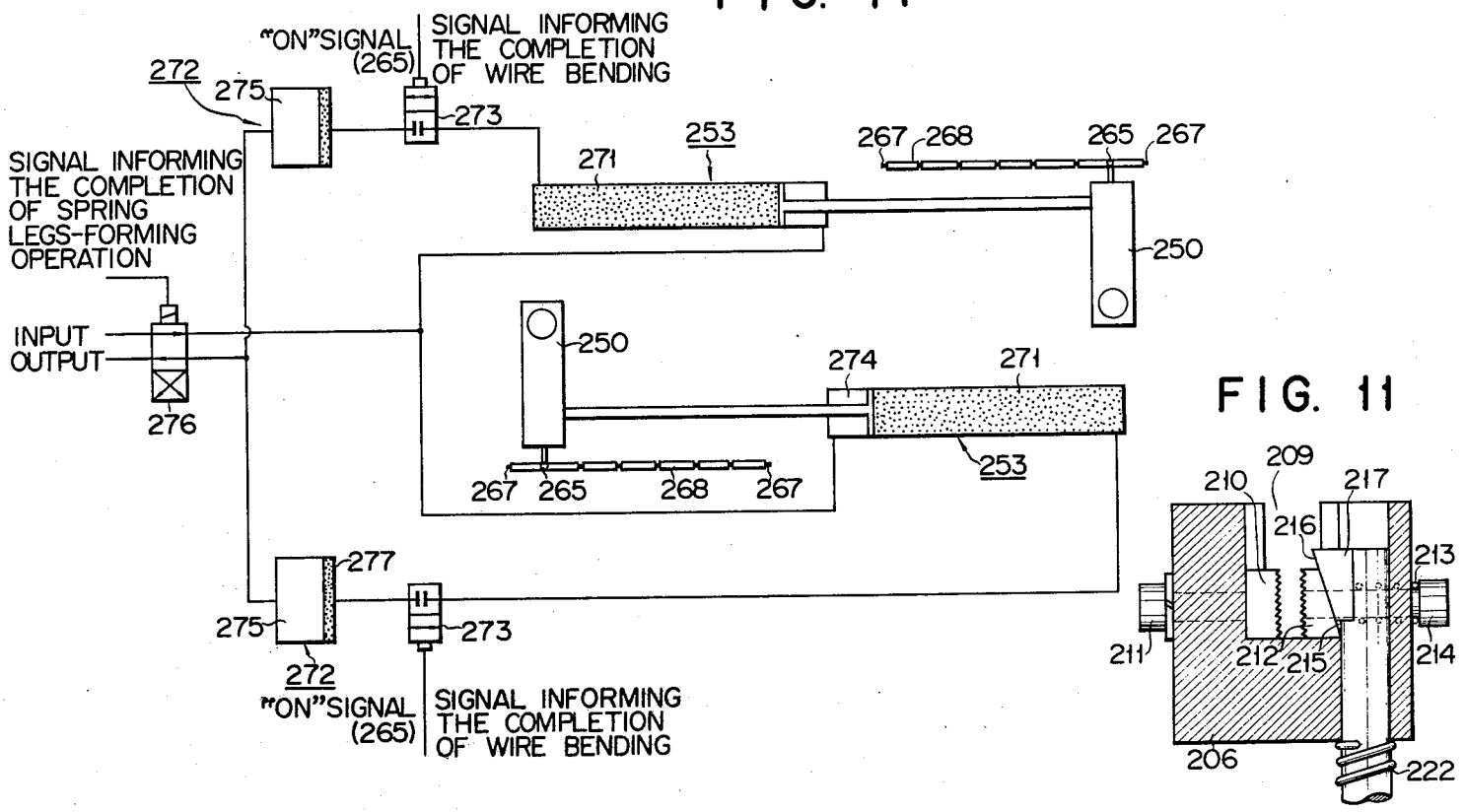
Figure 16:
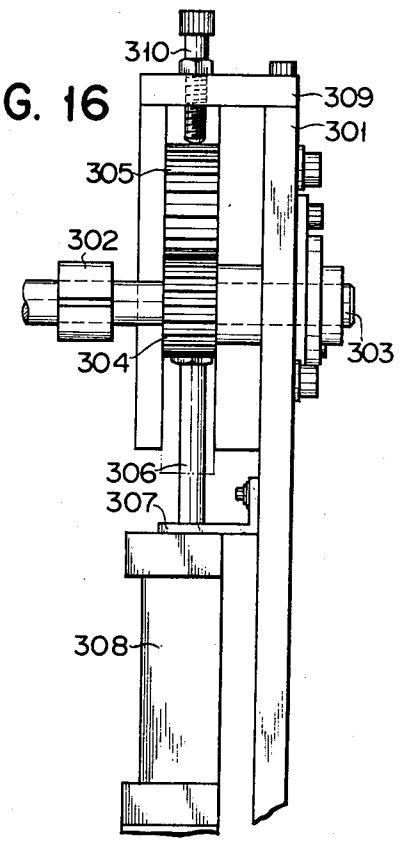
Figure 15:
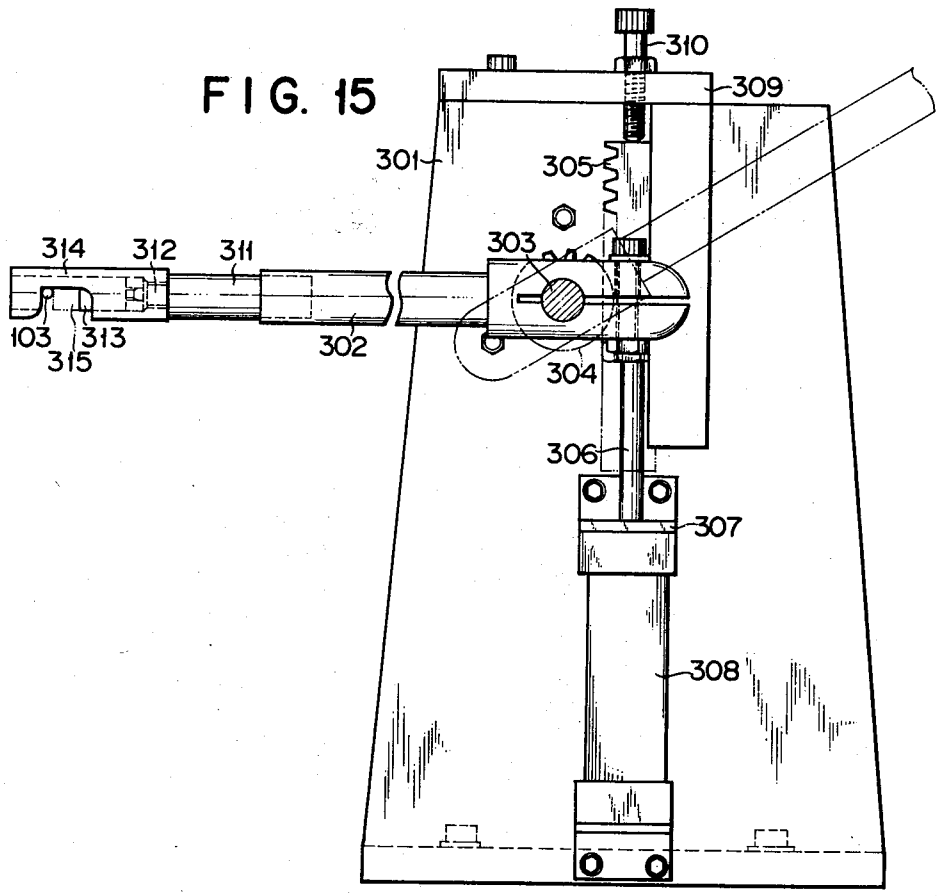
Figure 17:
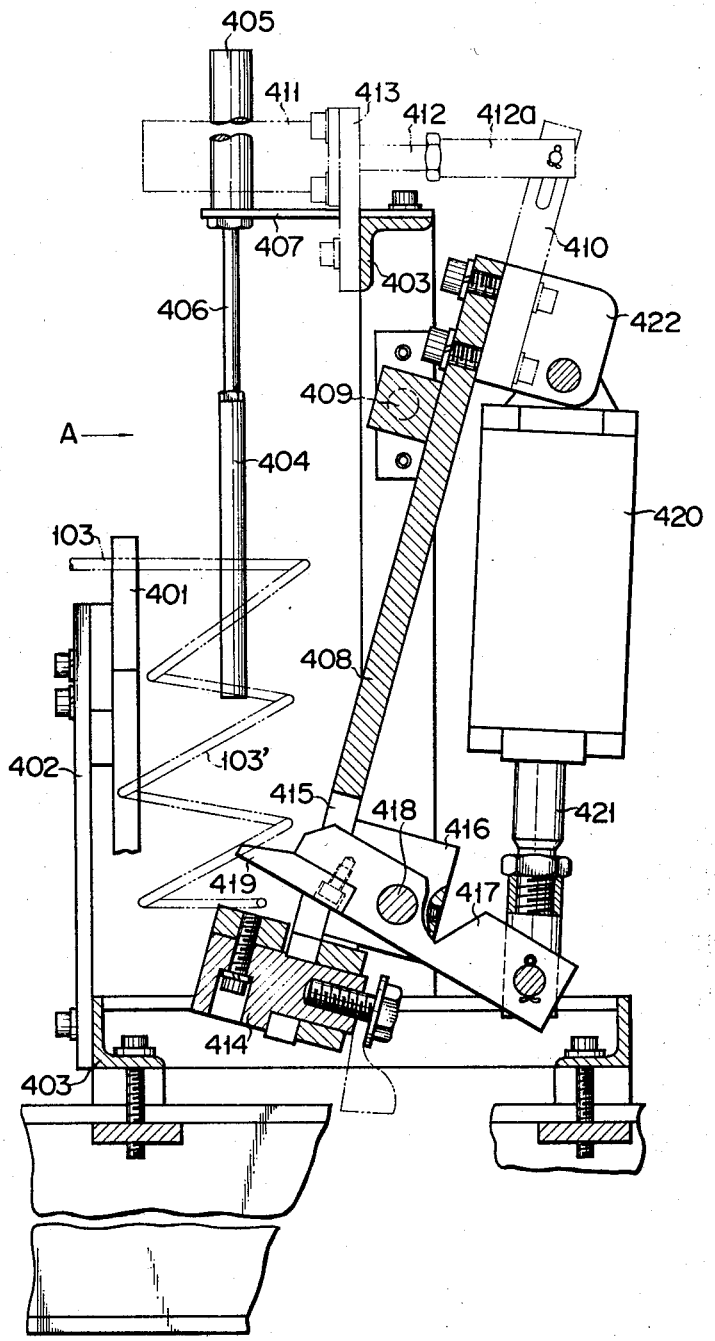
Figure 18:
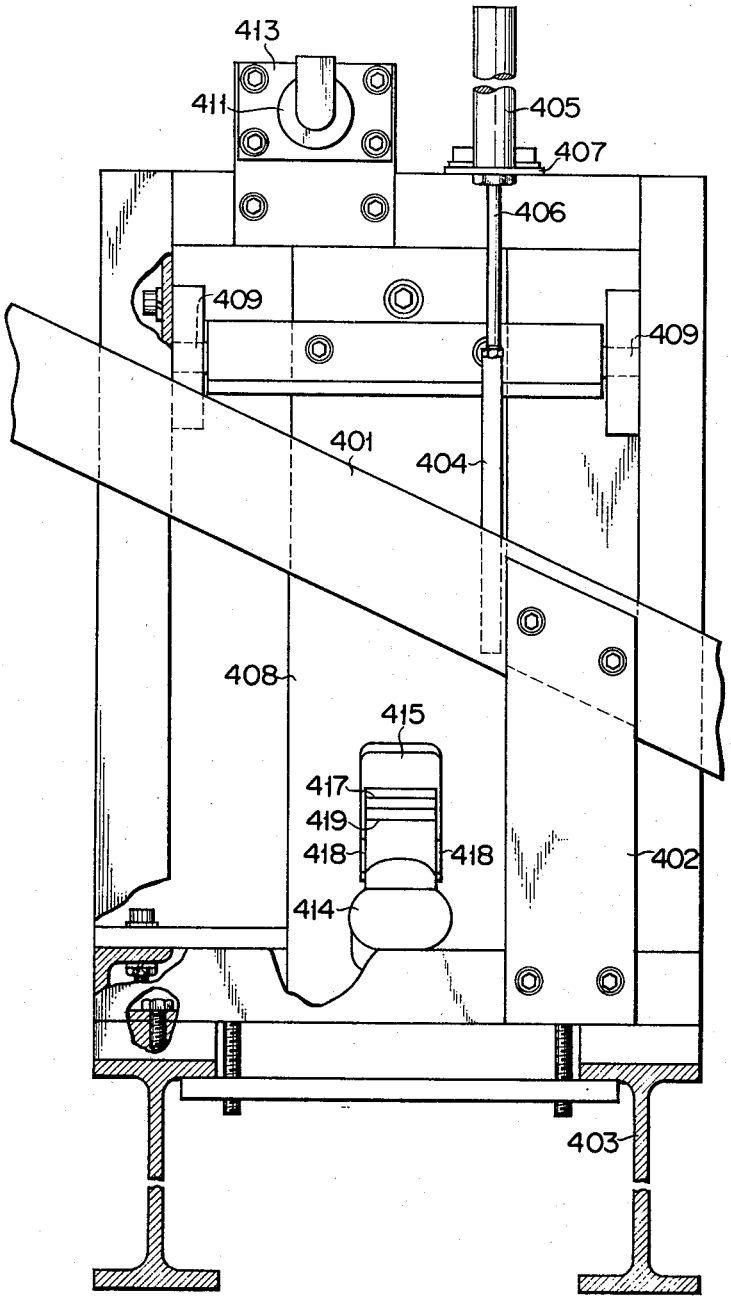
Figure 19:
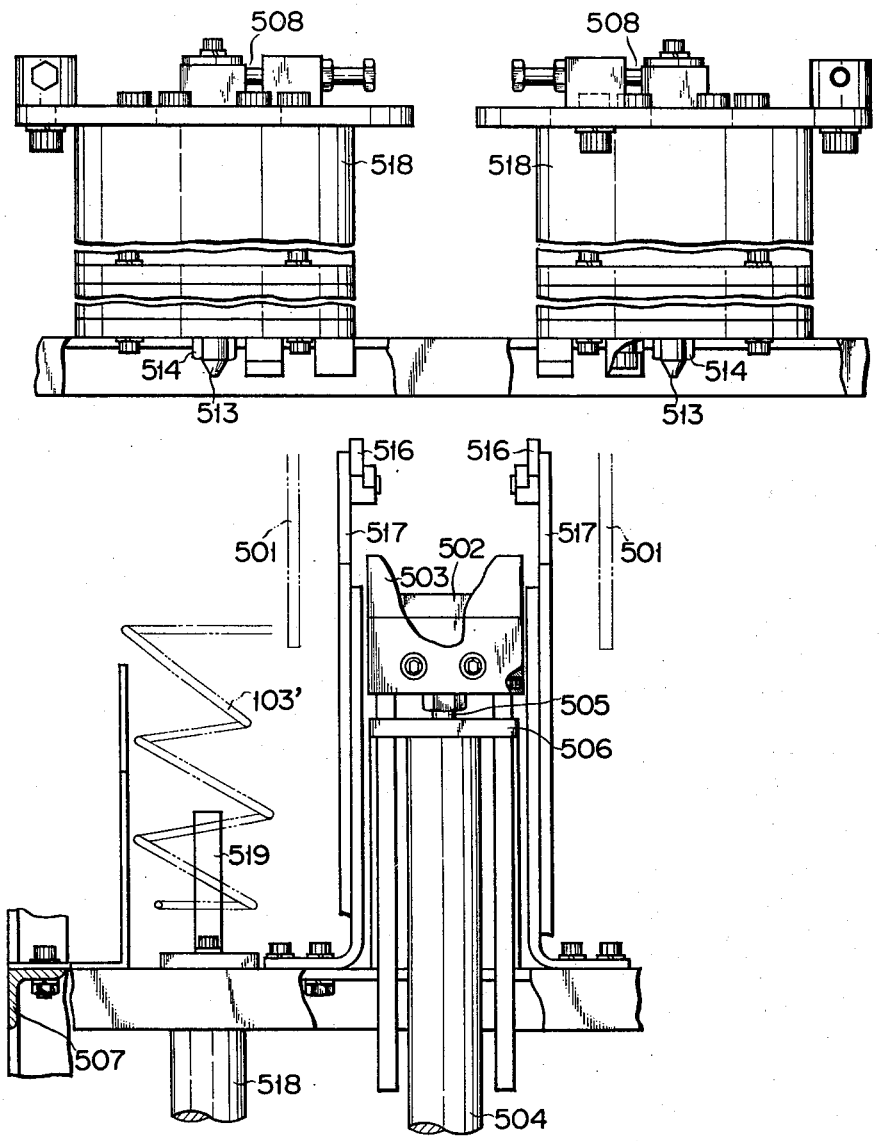
Figure 20:
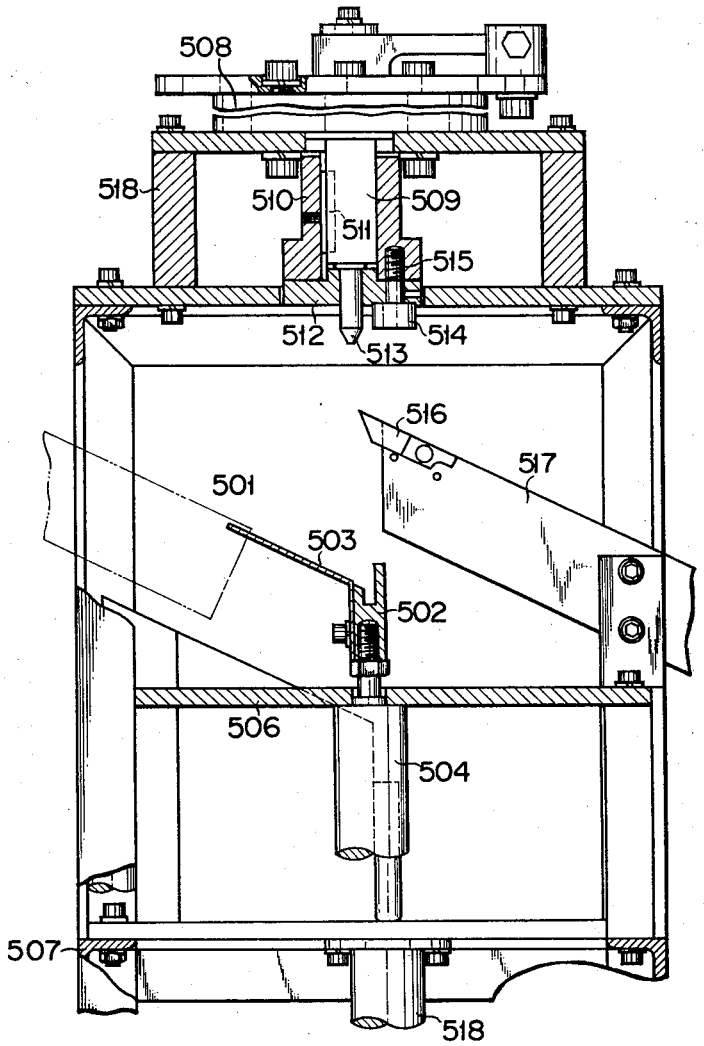
Figure 21:
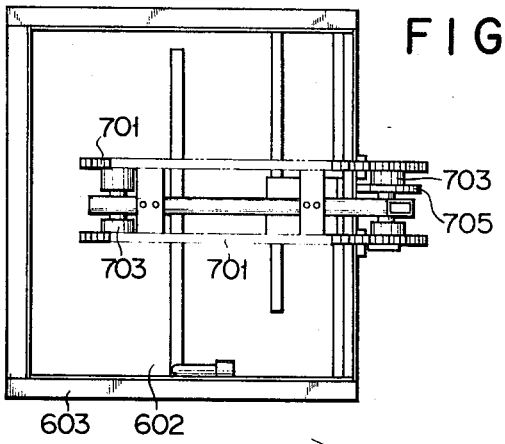
Figure 22:
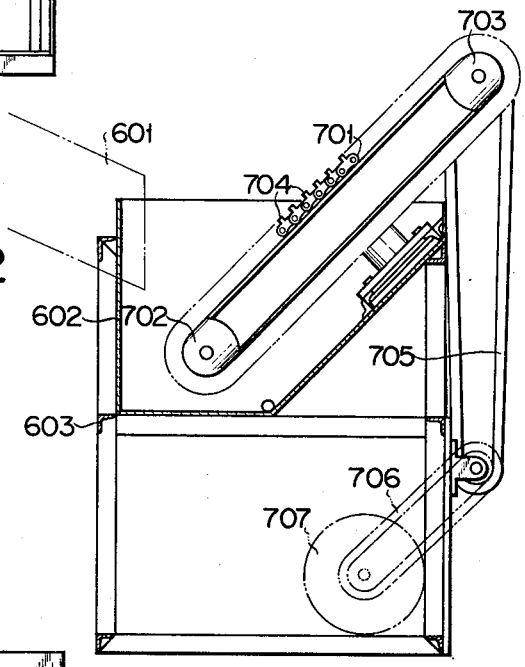
Figure 23:
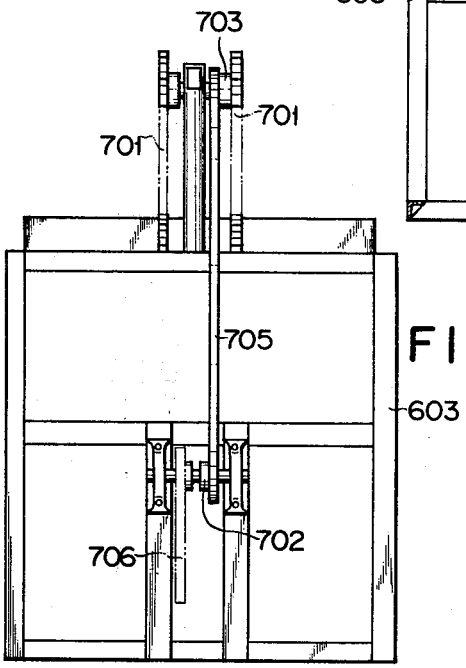
Figure 24:
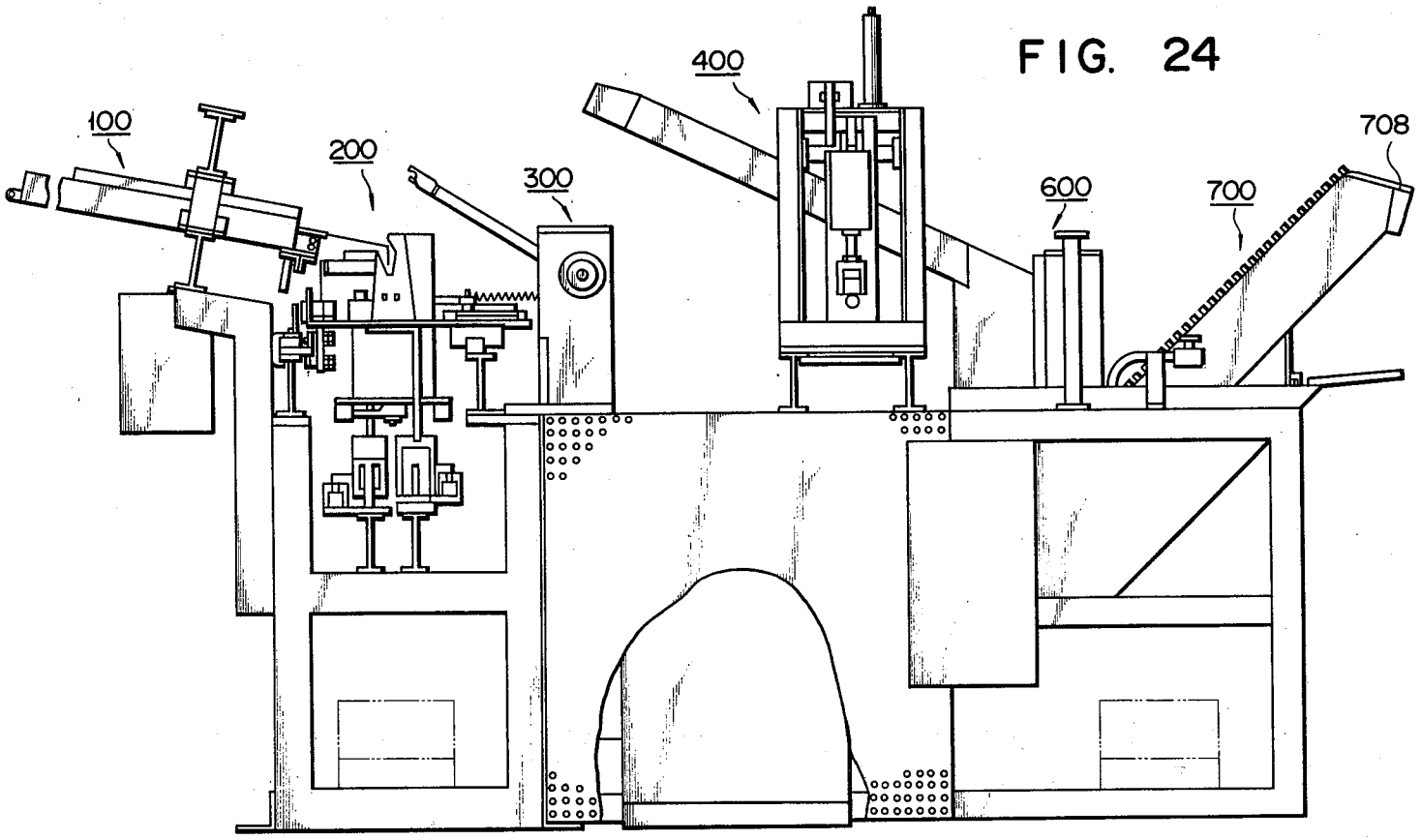
Figure 25A:
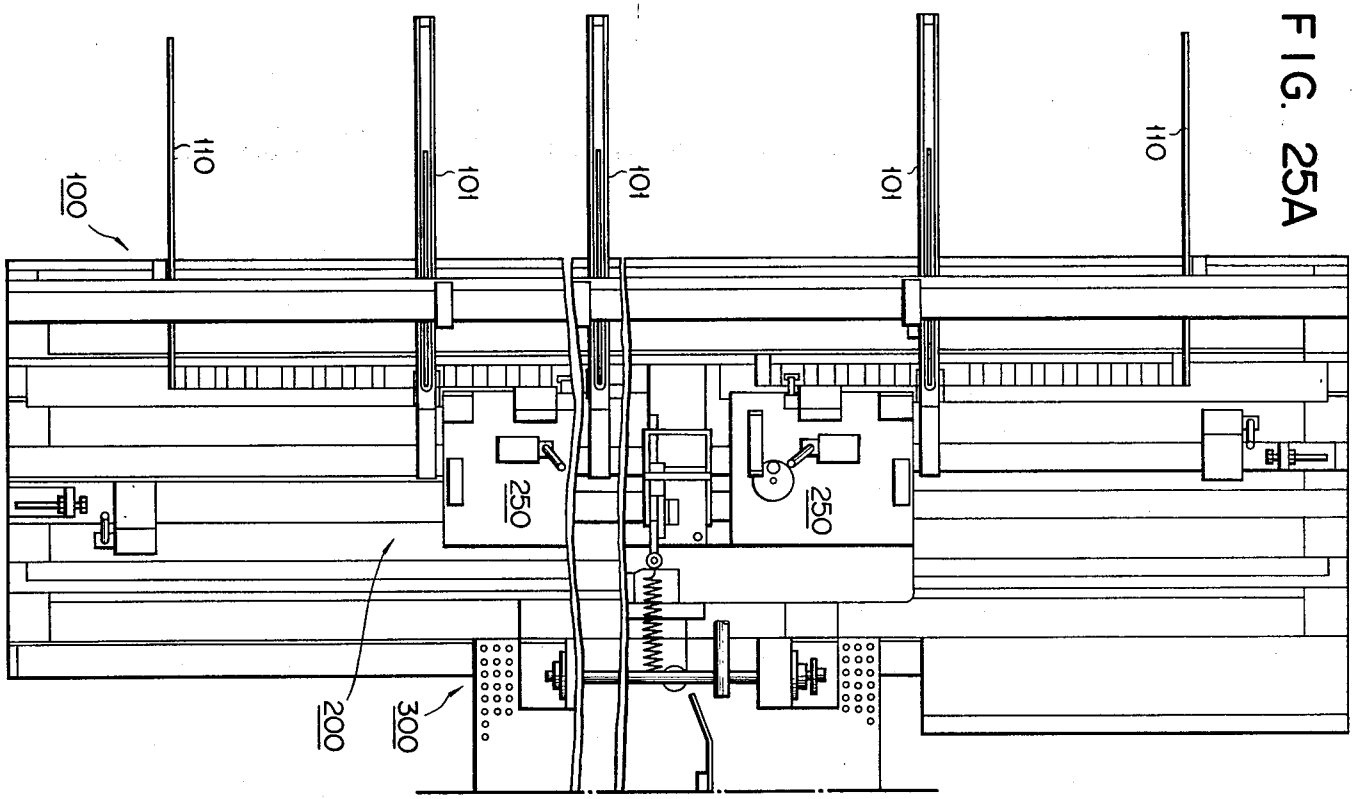
Figure 25B:
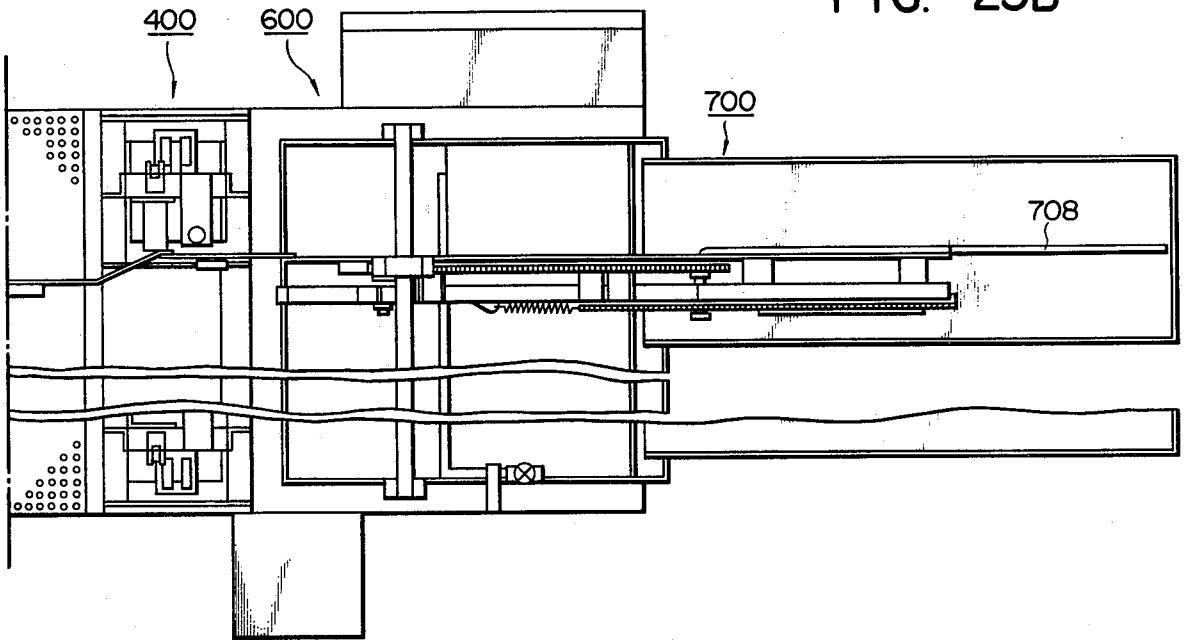
Figure 26:
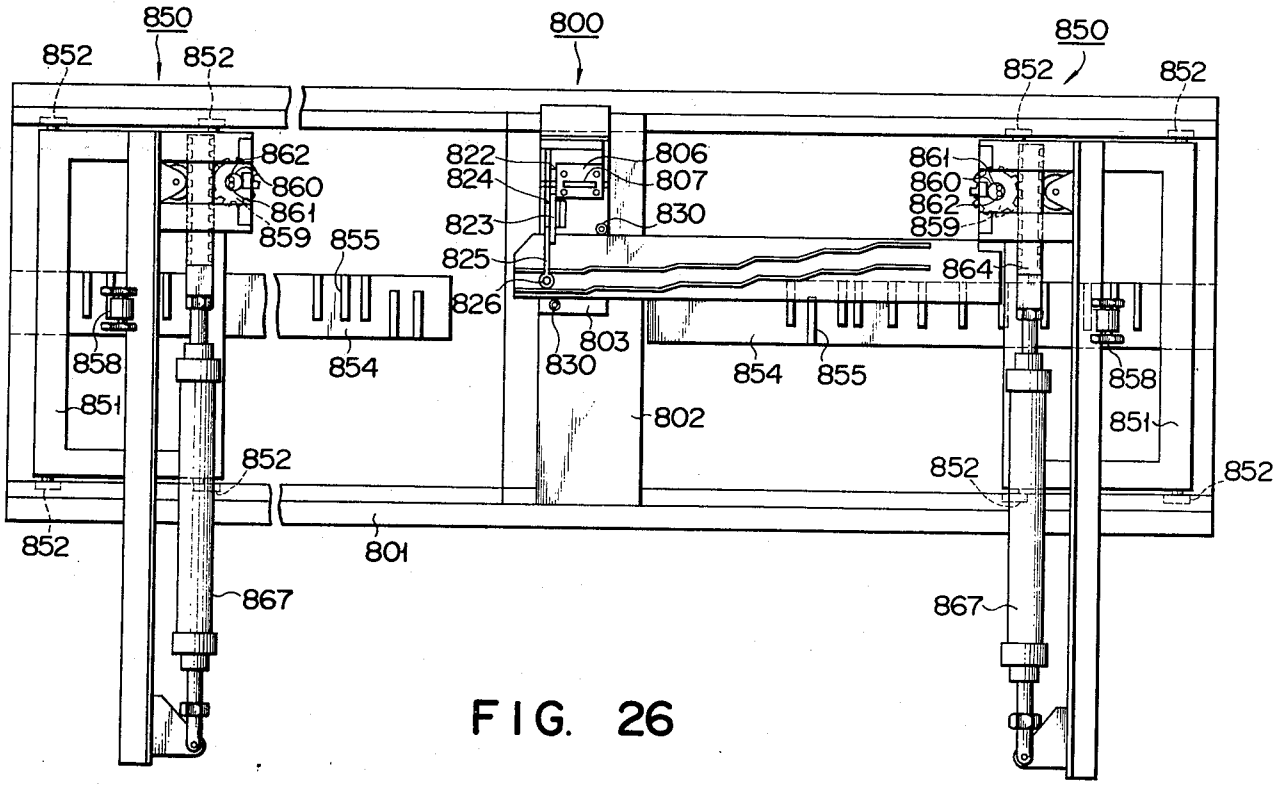
Figure 27:
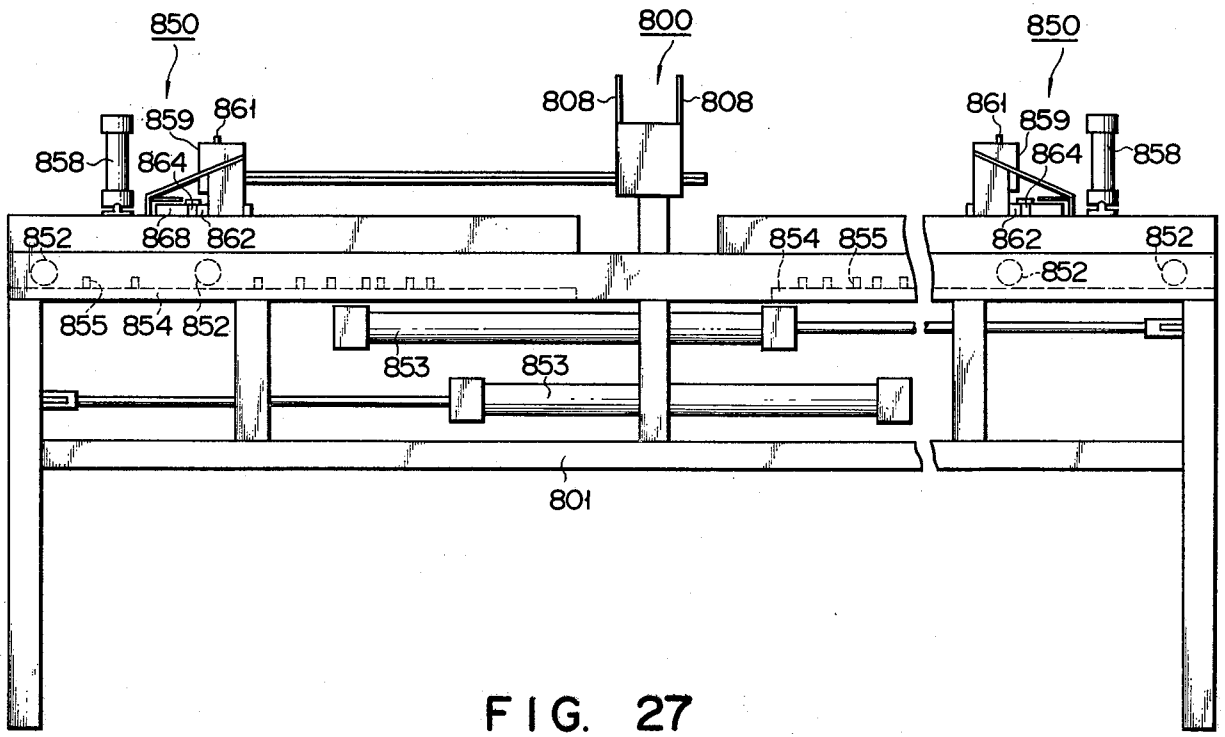
Figure 28:
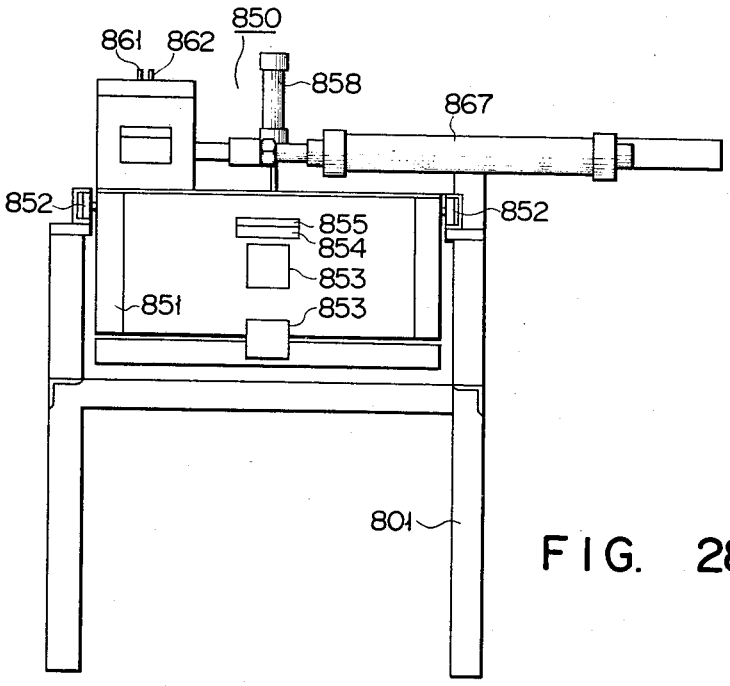
Figure 30:
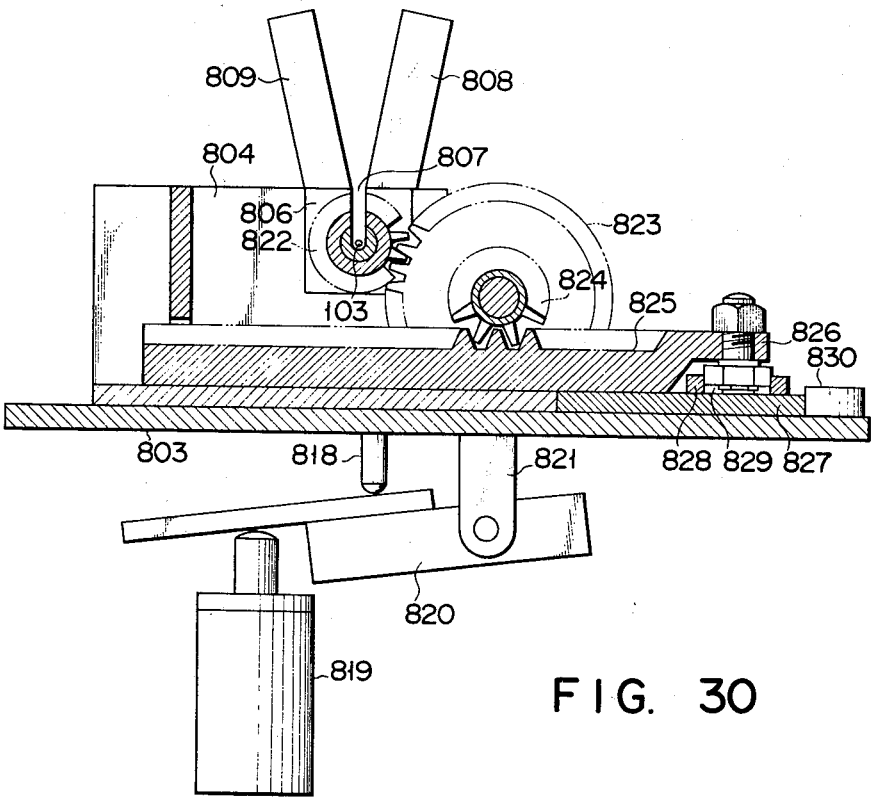
Figures 29, 31, 32:
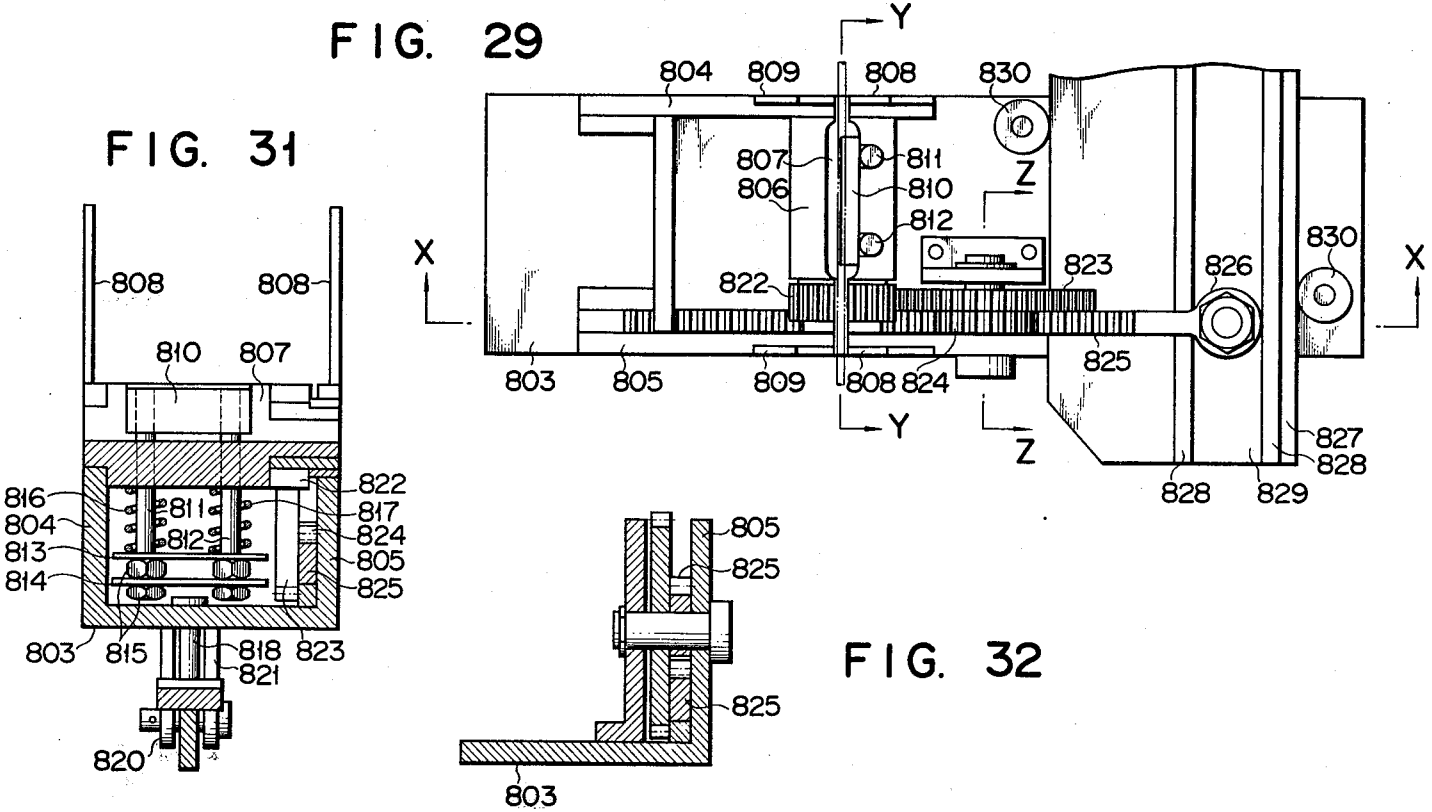
Figure 33:
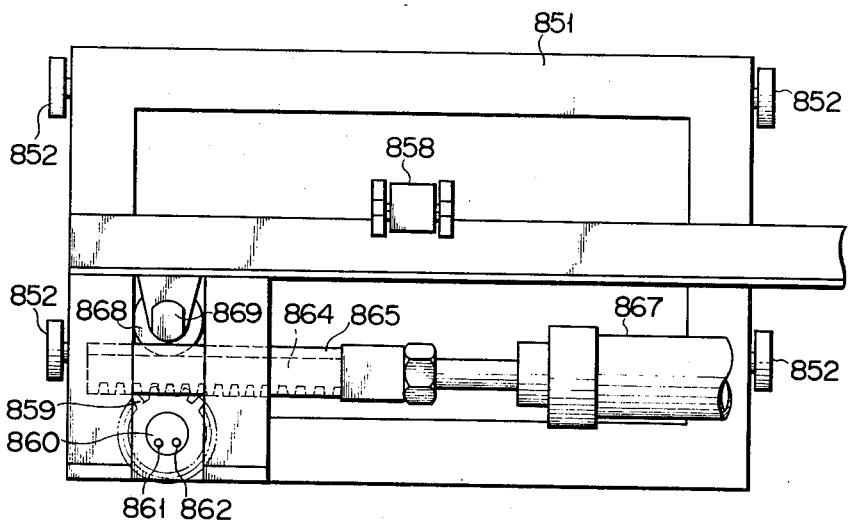
Figure 34:
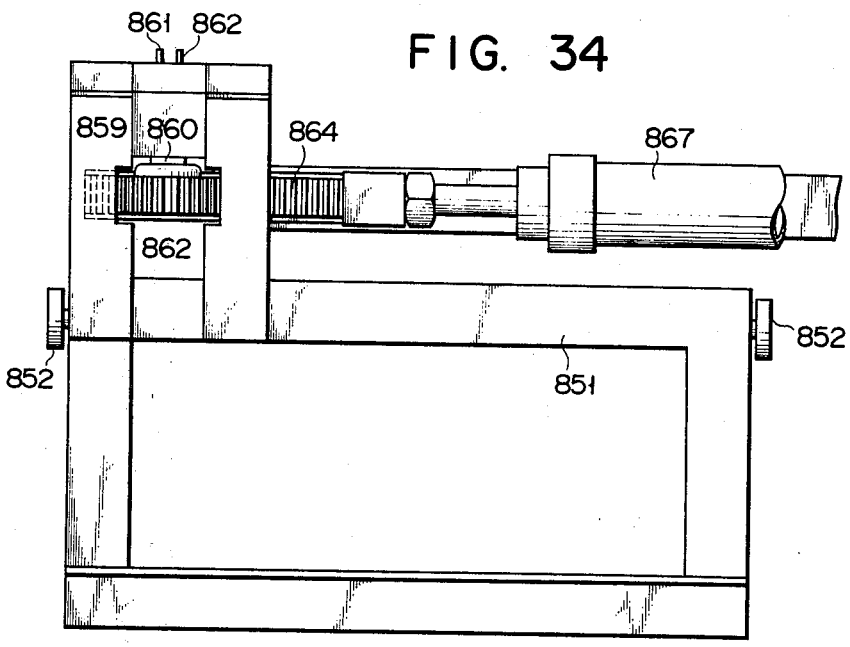
Figure 35:
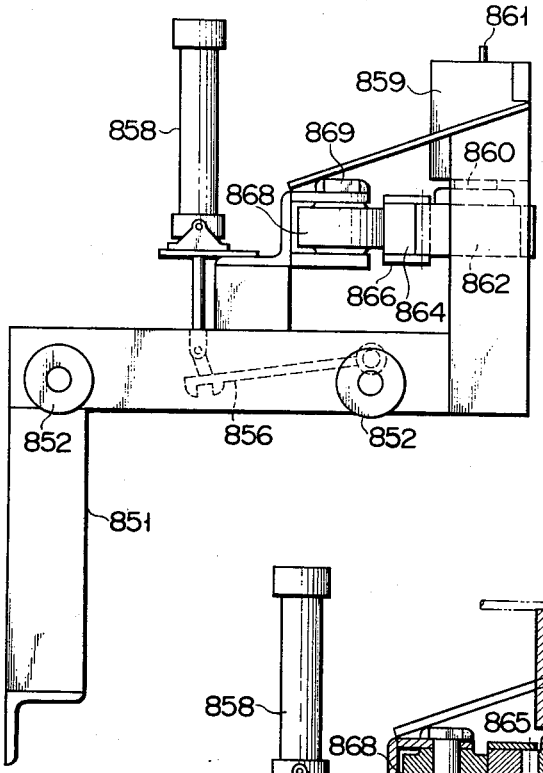
Figure 36:
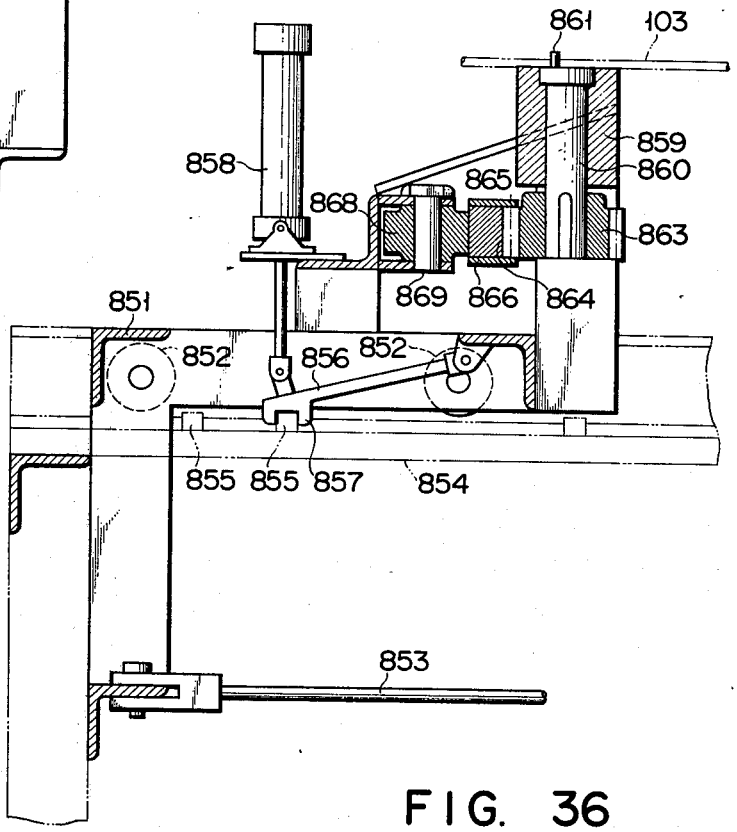

FIGS. 6A and 6B comprise a schematic plan view of a wire spring-manufacturing apparatus according to an embodiment of this invention;

FIG. 7 is a side view of the apparatus of FIG. 6;

FIG. 8 is a side view of a wire feeder according to the invention;

FIG. 9 is a plan view of a wire-rotating device included in a spring leg-fabricating device according to the invention;

FIG. 10 is a side view of the wire-rotating device of FIG. 9;

FIG. 11 is a cross sectional view of a wire-holding member included in the wire-rotating device of FIGS. 9 and 10;

FIG. 12 is a plan view of a wire-bending member included in the spring leg-fabricating device according to the invention;

FIG. 13 is a side view of the wire-bending member of FIG. 12;

FIG. 14 schematically illustrates a mechanism for controlling the wire-bending member of the invention;

FIG. 15 is a side view of a wire-transporting device according to the invention;

FIG. 16 is a front view of the wire-transporting device of FIG. 15;

FIG. 17 is a front view of a heat-treating device according to the invention;

FIG. 18 is a side view of the heat-treating device of FIG. 17 as observed in the direction of arrow A indicated in FIG. 17;

FIG. 19 is a front view of a device according to the invention for bending an intermediate support wire spring;

FIG. 20 is a side view of the bending device of FIG. 19;

FIG. 21 is a plan view of an assembly of a waxapplying device and a wire-spring discharging device both according to the invention;

FIGS. 22 and 23 are respectively a side view and front view of the assembly of the wax-applying device and wire spring-discharging device of FIG. 21;

FIGS. 24 and 25 (A and B) are respectively the plan and side views of an apparatus according to another embodiment of the invention for fabricating a main wire spring;

FIGS. 26, 27 and 28 are respectively the plan, back and side views of a wire spring-bending device according to a modification of the invention;

FIG. 29 is a plan view of a wire-rotating device included in the above modification;

FIG. 30 is a sectional view on line X—X of FIG. 29;

FIG. 31 is a sectional view on line Y—Y of FIG. 29;

FIG. 32 is a sectional view on line Z—Z of FIG. 29;

FIGS. 33, 34 and 35 are respectively the plan, side and front views of a wire spring-bending member included in the wire spring-bending device of FIG. 26; and FIG. 36 is a fractional sectional view of the wire spring-bending device of FIG. 35.

There will first be described the operation of a wire spring-manufacturing apparatus according to an embodiment of this invention particularly with respect to the case where an intermedite support wire spring is fabricated.

As seen from FIGS. 6 and 7, the wire spring-manufacturing apparatus of this invention comprises, as counted from the left side of the figures in the order of working steps, a wire feeder 100; a spring leg-fabricating device 200; a wire spring-transporting device 300; a wire spring heat-treating device 400; a wire spring-bending device 500; a rustproof wax-applying device 600; and a wire spring-discharging device 700.

The wire feeder 100 delivers straight wires one after another to the succeeding spring leg-fabricating device 200 by the arrangement shown in FIG. 8. Namely, two pairs of inclined rails 101 are spatially fixed on a frame 102. A plurality of parallel disposed straight wires 103 are supported on said rails 101 so as to extend crosswise over said rails. A spacer 105 is placed above the frame 102 at an adjustably larger space 104 than the thickness of a wire 103. Fixed on the lower end portion of the rail 101 is a plate member 106 in a state separated from the lower end edge of the spacer 105 at a space corresponding to the thickness of a wire 103. The upper edge of the plate member 106 prevents a plurality of wires supported on the inclined rail 101 from rolling downward. Provided at the lower end of the plate member 106 is a projecting rail 107 extending to the succeeding spring leg-fabricating device 200 with the base portion of said projecting rail 107 made flush with the upper surface of the plate member 106. Disposed below the upper end of the plate member 106 is a push member 109 vertically moved by a cylinder member 108. That side of said push member 109 which faces the spring leg-fabricating device 200 is tapered.

A plurality of parallel disposed straight wires 103 supported crosswise on the two pairs of rails 101 are set in good order when passing through the spaces 104 between the rails 101 and spacers 105. The foremost wire 103 is brought to rest by abutting against the upper end face of the plate member 106. When the push member 109 rises by the operation of the cylinder member 108, the foremost wire 103 is lifted and transferred on to the plate member 106 by the tapered upper end surface of the push member 109 and then passes over the plate member 106 and projecting extension rail 107 to the spring leg-fabricating device 200.

The two pairs of rails 101 included in the wire feeder 100 are inclined as shown in FIG. 7 to cause each of a plurality of wires 103 successively to slide over the rails 101 gravitationally through the spaces 104. Thereafter, the wire 103 is transferred on to the plate member 106 by the push member 109 and further slides to the spring leg-fabricating device 200. The right and left portions of the wire feeder 100 are made symmetrical with each other. A pair of stop members 110 are provided on both sides of the wire-feeder 100 to prevent the displacement of the wires 103 crosswise of the feeder 100.

The spring leg-fabricating device 200 comprises a wire-rotating device 201 disposed at the center and a pair of wire-bending devices 250 positioned on both sides of said wire-rotating device 201. The wire-rotating device 201 of FIGS. 9 and 10 is constructed in the following manner. A substrate 203 is fixed on a frame 202. A pair of mutually facing support plates 204, 205 are fixed in the prescribed place on each side of the substrate 203 so as to project upward. A wire-rotating member 206 is provided between the upper portions of the support plates 204, 205 so as to rotate about the corresponding shafts 207, 208. The wire-rotating member 206 is bored with a groove 209 having a U-shaped cross section, which extends throughout said wire-rotating member 206 along the axis of rotation. In the groove 209 a wall plate 210 is fixed by a bolt 211 to one of the inner walls of the groove 209. The other inner wall of the groove 209 which faces the wall plate 210 is fitted with a movable plate 212. This movable plate 212 is fixed on a bolt 214 slidably passing through the wall of the wire-rotating member 206, and normally urged away from the wall plate 210 by a coil spring 213 wound about the bolt 214. A pair of cutout surfaces 215 each having a tapered cross section are spatially provided on the backside of the movable plate 212. A pair of push plates 217, 218 each having a tapered surface 216 corresponding to the aforesaid tapered surfaces 215 are pressed thereagainst. The push plates 217, 218 are securely contacted by the upper end portions of a pair of vertically movable shafts 219, 220 which slidably penetrate the wire-rotating member 206. A connection plate 221 is fitted to the lower end portions of the vertically movable shafts 219, 220 to join them together. Those portions of the vertically movable shafts 219, 220 which are positioned between the wire-rotating member 206 and the connection plate 221 are wound with coil springs 222, which normally urge downward the push plates 217, 218, thereby causing the movable plate 212 to be shifted toward the wall plate 210.

Provided below the center of the connection plate 221 is a push rod 223, the upper end of which is suitably pressed against the underside of the connection plate 221 so as to effect the vertical movement of the shafts 219, 220. The vertical movement of said push rod 223 is carried out by the cylinder 224 and lever 225. The lever 225 is rotatably fitted to an L-shaped plate member 226 which is fixed to the underside of the substrate 203 and swings in the direction of the indicated arrow by the vertical movement of the cylinder 224 fitted to a plate member 227 which in turn is fixed on the frame 202, thereby effecting the vertical movement of the push rod 223. A stop member 228 is fixed to the lower end of the push rod 223. A spring 229 is stretched between the stop member 228 and substrate 203 normally to urge downward the push rod 223. Fixed to one side of the wire-rotating member 206 is a minor gearwheel 230 to turn the wire-rotating member 206 by being engaged with a major gearwheel 231. This major gearwheel 231 is set in place coaxially with a pinion gear 232, and rotatably supported by a shaft 234 between the support plate 204 and auxiliary support plate 233 (FIG. 9). The pinion gear 232 is engaged with a rack gear 235 which is normally pulled by a spring 236 so as to have the head portion 237 of said rack gear 235 pressed against the stepped stop member 239 (formed, as shown in FIG. 6, of a plurality of blocks 240 having different widths) provided on a drive plate 238.

When the drive plate 238 moves at right angles to the longitudinal direction of the rack gear 235, then the rack gear 235 moves by being guided over the surface of the stepped stop member 239. In this case, the drive plate 238 linearly moves, as later described, in accordance with the travel of the wire-bending device 250. Referential numerals 241, 242 denote guide rollers to guide the drive plate 238 in its traveling direction. The minor gearwheel 230 is provided with a groove 243 corresponding to the groove 209 of the wire-rotating member 206. The paired support plates 204, 205 are also bored with the corresponding grooves 244, 245.

There will now be described the operation of the wire-bending device 250 with reference to FIGS. 12 and 13 showing one of a pair of said wire-bending devices 250 of the same construction arranged in symmetrical relationship with respect to the wire-rotating device 201. A substrate 251 is made to move along the frame 202 by means of rollers 252. The substrate 251 is connected to a drive cylinder member 253 through a connecting rod 254. Fixed to the underside of the substrate 251 is a rotation power source 255, the rotating shaft 256 of which projects above the substrate 251. A cylindrical member 257 is fixed to the periphery of the rotating shaft 256 by a key 258. A rotating disk 259 is mounted on the cylindrical member 257. The central shaft 260 constituting an integral part of the rotating shaft 256 penetrates the rotating disk 259 at the center to project upward. A projection 261 is formed on the rotating disk 259 apart from the center thereof. A screw 262 (FIG. 13) constituting an integral part of the projection 261 penetrates the rotating disk 259 to be fixed to the cylindrical member 257. Disposed aside of the projection 261 is a wire cover plate 263, the end face of which is in alignment with the peripheral wall of the projection 261. The wire cover plate 263 is fixed on the substrate 251 by a support member 264. A switch 265 is set in place by a support member 266 having an L-shaped cross section so as to detect the arrival of the substrate 251, namely, the wire-bending device 250 at a prescribed position. Mounted on the frame 202 is a band-shaped plate 268 provided with a plurality of projections 267 set apart from each other at a prescribed interval in order to intermittently actuate the switch 265. When the switch 265 moves to a prescribed point jointly with the substrate 251, the movable terminal member 269 of said switch 265 rotates in abutment against the projection 267 to render said switch 265 conducting. A switch 270 is mounted, as shown in FIG. 12, on the substrate 251 to detect the rotation of the cylindrical member 257.

A straight wire 103 delivered from the wire feeder 100 is clamped substantially at the center in the wire-rotating device 201. The central portion of the wire 103 is inserted into the groove 209 of the wire-rotating member 206 to be clamped between the wall plate 210 fixed within said groove 209 and the movable plate 212. The clamping of the wire 103 is effected through the steps of returning the cylinde 224 to bring the lever 225 back to the position shown in phantom (2 dots-chain line) in FIG. 10, letting fall the push rod 223 by the spring 229, bringing down the vertically movable shaft 219 and in consequence the push plates 217, 218 jointly therewith by the spring 222, and finally shifting the movable plate 212 toward the wall plate 210 by the tapered surface of said push plates 217, 218.

In the wire-rotating device 201, the drive of the rack gear 235 leads to the rotation of the pinion gear 232, major gearwheel 231 and minor gearwheel 230, causing the clamped wire 103 to be rotated jointly with the wire-rotating member 206 about the axis thereof. When a pair of wire-bending devices 250 disposed on both sides of the wire-rotating device 201 are so moved as to approach each other, then the rack gear 235 is moved by the stepped stop member 239 formed on the drive plate 238. In the wire-bending device 250, each end of the wire 103 is clamped between the control shaft 260 and projection 261. The cylindrical member 257, disk 259, central shaft 260 and projection 261 are rotated by the rotation power source 255. In this case, the projection 261 revolves about the periphery of the central shaft 260, causing both ends of the wire 103 clamped between the central shaft 260 and projection 261 to be bent for example at right angle. The wire cover plate 263 prevents the straight portion of the wire 103 from being flexed during said bending. When the paired wire-bending devices 250 are so moved as to approach each other by the operation of the cylinder 253, a switch 265 is also moved jointly with each wire-bending device 250 and rendered conducting when the movable terminal 269 of said switch 265 abuts against any of the projections 267 formed on the band-shaped plate 268 fixed on the frame 202. The intermittent actuation of the switch 265 stops the paired wire-bending devices 250 each time at a prescribed position, thus repeating the rotation of the wire 103 and the bending of both ends thereof. As the result, a hanging spring leg bent at several points in a rectangular form is provided at both ends of the wire 103. The completion of the rotation of the cylindrical member 257 included in the wire-bending device 250, namely, the completion of each successive bending of the wire 103 is detected by the switch 270.

There will now be described by reference to FIG. 14 the operation of a control device by which the paired wire-bending devices 250 are brought to rest at a prescribed position, each time the switch 265 is actuated and then are drawn near to each other by the cylinder 253. An electromagnetic valve 273 is provided between the oil chamber 271 and oil tank 272 of the cylinder 253. Said electromagnetic valve 273 is closed upon receipt of a signal denoting the actuation of the switch 265 and opened upon receipt of a signal showing the completion of wire bending from a switch 270 (FIG. 12). There is further provided a changeover electromagnetic valve 276, one opening of which is connected to the air chamber 274 of the cylinder 253 and the other opening of which is connected to the air chamber 275 of the oil tank 272. This changeover electromagnetic valve 276 normally has its inlet connected to one opening and its outlet connected to the other opening. This condition of connection is changed over upon receipt of an output signal from a detector (not shown) of the completed fabrication of a spring leg. The inlet of said changeover electromagnetic valve 276 is supplied with compressed air. Compressed air is delivered to the air chamber 274 of the cylinder 253 through the changeover electromagnetic valve 276, and the oil of the oil chamber 271 of the cylinder 253 is brought into the oil chamber 277 of the oil tank 272 through the electromagnetic valve 273, thereby putting the cylinder 253 into operation to draw the paired wire-bending devices 250 to each other. At this time, the air in the air chamber 275 of the oil tank 272 is expelled to the outside through the changeover electromagnetic valve 276. As previously mentioned, when the switch 265 moving jointly with the wire-bending device 250 is actuated by having its movable terminal pressed against any of the projections 267 formed on the band-shaped plate 268, then a signal showing said actuation closes the electromagnetic valve 273. As the result, the oil outlet of the oil chamber 271 of the cylinder 253 is closed to stop its operation with compressed air still supplied thereto. The stoppage of the cylinder 253 brings the wire-bending device 250 to rest at the prescribed point defined by the actuation of the switch 265. When the operation of the wire-bending device 250 is brought to an end, the electromagnetic valve 273 is opened upon receipt of a signal denoting the completion of wire bending from the switch 270, and the oil outlet of the oil chamber 271 of the cylinder 253 is also opened to put said cylinder into operation with the resultant mutual approach of the paired wire-bending devices 250. The above-mentioned operating cycle is repeated thereafter. As previously described, when the fabrication of a spring leg is completed, the inlet of the chageover electromagnetic valve 276 is conversely connected to the aforesaid other opening and the outlet thereof is also conversely connected to the aforesaid one opening upon receipt of an output signal from a detector (not shown) of said completion. As the result, compressed air is conducted into the air chamber 275 of the oil tank 272 through the changeover electromagnetic valve 276, the oil of the oil chamber 277 of said oil tank 272 is delivered to the oil chamber 271 of the cylinder 253 through the electromagnetic valve 273, and the air of the air chamber 274 of the cylinder 253 is discharged through the changeover electromagnetic valve 276, thereby causing the cylinder 253 and in consequence the paired wire-bending devices 250 to be moved backward.

A wire 103, both ends of which were formed into spring legs in the spring leg-fabricating device 200 is delivered to the heat-treating device 400 by the transporting device 300, which is constructed as shown in FIGS. 15, 16. A swingable arm 302 is pivotally supported on a support member 301 so as to have the rear end of said arm 302 rotated about a shaft 303. The shaft 303 is fitted with a pinion gear 304, with which a rack gear 305 is engaged for vertical movement. The rack gear 305 is fixed to a movable shaft 306, which projects above a cylinder 308 mounted on the support member 301 by an L-shaped plate member 307. The upper limit to the vertical movement of said cylinder 308 is suitably determined by a bolt 310 threadably penetrating the upper board 309 of the support member 301. The forward end of the swingable arm 302 is fitted with a cylinder 311. The forward end of a movable shaft 312 received in the cylinder 311 is fitted with a clamping member 313. The clamping member 313 is made to move lengthwise through a cylindrical support member 314 fixed to the forward end of the cylinder 311. The cylindrical support member 314 has its underside bored with a notch 315, through which a wire 103 is introduced.

When a wire 103 held on the spring leg-fabricating device 200 is transferred to the heat-treating device 400, the cylinder 308 and in consequence the rack gear 305 are first moved upward. As the result, the pinion gear 304 is rotated to turn the swingable arm 302 forward the spring leg-fabricating device 200 until said arm 302 takes a substantially horizontal position. When the arm 302 is brought to this position, the straight portion of the wire 103 held on the spring leg-fabricating device 200 is inserted into the notch 315 of the cylindrical support member 314. Thereafter, the cylinder 311 is operated to push the clamping member 313 forward to cause the straight portion of the wire 103 to be clamped between the forward end of the clamping member 313 and the inner wall of the notch 315. At this time, the cylinder 308 is moved backward to bring down the rack gear 305 and in consequence rotate the pinion gear 304, thereby turning the swingable arm 302 toward the heat-treating device 400. At this time, the clamping member 313 is retracted by the operation of the movable shaft 312 to disengage the wire 103 from the cylindrical support member 314 and transfer the wire 103 to the heat-treating device 400. According to this invention, the above-mentioned transporting device 300 is spatially provided in pair as shown in FIG. 6.

The heat-treating device 400 is constructed as shown in FIGS. 17 and 18. An inclined rail 401 is fixed to a support plate 402 which in turn is fitted to the lower end of a frame 403. A wire stop member 404 is disposed aside of the intermediate part of said inclined rail 401. A wire 103 sliding downward from the top of the inclined rail 401 is kept at a prescribed position on said rail 401 by the stop member 404, which is held by a movable shaft 406 projecting downward from a cylinder 405. The cylinder 405 is mounted on a plate 407, which is fixed to the upper end of the frame 403. Provided aside of the intermediate part of the rail 401 is a rotatable rod 408, the near upper end part of which is fixed in place by a shaft 409 in proximity to the upper end of the frame 403, thereby enabling both end portions of said rod 408 to rotate about said shaft 409. An extension rod 410 is fixed to the upper end portion of the rotatable rod 408 and connected to a cylinder 411 through a movable shaft 412 and extension rod 412a. The cylinder 411 is fixed to a vertical plate 413 attached to the upper end of the frame 403. The lower end of the rotatable rod 408 is fitted with a stationary electrode 414. An opening 415 is provided near the lower end of the rotatable rod 408. Disposed in proximity to both sides of the opening 415 are a pair of projecting members 416. A rotatable member 417 is pivotally fitted to a shaft 418 between the projecting members 416. The forward end of the movable member 417 is fitted with a movable electrode 419 which projects so as to face the upper surface of the stationary electrode 414. Both movable member 417 and movable electrode 419 extend into the opening 415 to move vertically therethrough. The rear end of the movable member 417 is connected to a movable shaft 421 which projects downward from a cylinder 420. This cylinder 420 is held by a projecting member 422 fitted to the upper end of the movable rod 408. A wire 103 delivered from the transporting device 300 gravitationally slides downward over the surface of the rail 401 and is brought to rest by abutting against the wire stop member 404. At this time, the cylinder 411 is operated to cause the movable rod 408 to swing so as to have its lower end portion shifted toward the rail 401. Upon said shifting, the lower end of the leg portion 103' of a wire spring 103 located aside of the rail 401 is placed between the stationary electrode 414 and movable electrode 419. Now the cylinder 420 is operated to cause the forward end of the movable member 417 to be swung downward so as to be clamped between the stationary electrode 414 and movable electrode 419. Upon introduction of electric current, the leg portion 103' of the wire spring 103 is subjected to heat treatment. The heat-treating devices 400 constructed as described above are spatially provided in pair as shown in FIG. 6. Electric current is introduced when the leg portions 103' formed at both ends of a wire 103 are respectively clamped between corresponding stationary electrodes 414 and movable electrodes 419. Upon completion of said heat-treatment, the cylinder 420 is moved backward to release the leg portion 103' from the clamping by the corresponding stationary electrode 414 and movable electrode 419. At this time, the cylinder 411 and in consequence the rotatable rod 408 are moved backward. Further, the cylinder 405 is actuated to disengage the wire 103 from the wire stop member 404. As the result, the wire 103 gravitationally slides downward over the surface of the rail 401 to be delivered to the succeeding spring leg-positioning device or, a wire spring bending device 500.

This wire spring-bending device 500 is provided to place spring legs already fabricated in a prescribed position in a horizontal plane relative to the straight portion of a wire by horizontally bending both ends thereof at which said spring legs are formed. Provision of this wire spring-bending device 500 is for the reason that the apparatus according to the first embodiment of the invention is intended to make an intermediate support wire spring. Where a main wire spring is fabricated, it is obviously unnecessary to use said wire spring-bending device 500.

There will now be described by reference to FIGS. 19 and 20 the operation of said wire spring-bending device 500. A rail 501 is provided in an inclined state so as to firm the lower extension of the inclined rail 401 of the heat-treating device 400. Disposed obliquely below the rail 501 is a wire holder 502. An auxiliary rail 503 is fitted between said wire holder 502 and the extension rail 501. The wire holder 502 is supported by a movable shaft 505 (FIG. 19) projecting above a cylinder 504 which is fitted to an intermediate support plate 506 fixed to a frame 507. Provided above both sides of the wire holder 502 are a pair of rotation power sources 508 which are mounted on the corresponding support members 518 fixed to the upper surface of the frame 507. The rotatable shaft 509 of each rotation power source 508 projects downward from the upper surface of the frame 507. A cylindrical member 510 is fixed to the periphery of the rotatable shaft 509 by means of a key 511. Fitted to the underside of the cylindrical member 510 is a disk 512 which is penetrated by a downward projecting control shaft 513 forming an integral part of the rotatable shaft 509. A projection 514 provided on the underside of the disk 512 apart from the center thereof is fixed to the cylindrical member 510 by means of the screw 515 of said projection 514 which penetrates the disk 512. A pair of one-way swingable members 516 which can turn upward but not downward are each held by the upper end of a rail 517 at a prescribed height from the wire holder 502. A cylinder 518 is fixed to the frame 507 parallel with the cylinder 504. A movable shaft 519 projects upward from said cylinder 518.

A wire 103 bearing spring legs at both ends which have been heat-treated by the heat-treating device 400 gravitationally slides downward over the inclined rail 501 and extension rail 503 to have the straight portion held by the wire holder 502. At this time, the cylinder 504 is operated to lift the wire holer 502 and in consequence the wire 103 therewith. While travelling upward, the wire 103 has its straight portion pressed against the undersides of the paired one-way swingable members 516. The wire 103 further travels upward past the one-way swingable members 516 while they are swung upward. When lifted to the uppermost position, the wire 103 has each end of its straight portion clamped between the central shaft 513 and projection 514 associated with the corresponding rotation power source 508. Actuation of said rotation power source 508 rotates the cylindrical member 510, disk 512, central shaft 513 and projection 514. Accordingly, the projection 514 rotates about the central shaft 513 to cause the wire 103 clamped between said projection 514 and central shaft 513 to have each end of its straight portion obliquely bent in a horizontal plane, thereby providing an intermediate support wire spring whose leg 103' takes an oblique position in a horizontal plane relative to the straight portion of the wire 103. Upon completion of the oblique positioning of the spring leg 103' the cylinder 504 is moved backward to bring down the wire holder 502 and in consequence the wire 103. During the descent, the wire 103 has its straight portion pressed against the upper surface of each one-way swingable member 516. Since, said one-way swingable members 516 can not swing downward, the wire 103 stays thereon and slides downward over the rails 517 to the succeeding wax-applying device 600, and is finally discharged therefrom by the transporting device 700. While the wire 103 is supported by the wire holder 502, the side of the spring leg 103' abuts against the movable shaft 519 of the cylinder 518, thereby enabling the wire 103 to hold a prescribed position. The cylinders 518, 504 are jointly operated to push upward the movable shaft 519, also helping the wire 103 to maintain a prescribed position.

The wax-applying device 600 and discharging device 700 are arranged as shown in FIGS. 21 to 23. A vessel 602 filled with liquid wax is disposed at the end of an inclined rail 601 joined with each inclined rail 517 of the spring leg positioning device 500 and fixed to a frame 603. There are provided a pair of parallel endless chains 701, each of which is received at one end in the vessel 602 and at the other end projects therefrom and is stretched over a pair of sprocket wheels 702, 703. The endless chain 701 has numerous engagement members 704 arranged at a prescribed interval along the entire length of said chain 701. The sprocket wheel 703 positioned at one end of the endless chain 701 is connected through two chains 705, 706 to the rotatable shaft of a motor 707 fixed to the frame 603.

The drive of the motor 707 rotates the sprocket wheel 703 through said two chains 705, 706. The rotation of the sprocket wheel 703 drives the endless chain 701. The wire 103 slides downward over the rail 601 into the vessel 602 filled with liquid wax to be treated therewith. After this treatment, the wire 103 is caught by the numerous engagement members 704 of the endless chain 701 to be transported to the exposed end of said chain 701. A pair of rails 708 are provided, as shown in FIGS. 6 and 7, at the exposed end of the endless chain 701 to take out the wire 103 transported thereby.

With the wire spring-fabricating apparatus according to the first embodiment of the invention, a straight wire 103 has both ends bent several times in succession to define a square or another polygon. The wire 103 is rotated about its axis to set each turn of the resultant spring at a prescribed angle in a vertical plane relative to the straight portion of the wire 103 to provide a polygonal hanging spring leg 103'. This invention bends each turn of the spring leg 103' only once at different points, providing high quality wire springs, and carrying out the entire process of feeding a straight wire 103 and fabricating a spring leg 103', followed by heat treatment and application of rustproof wax.

The foregoing description refers to the first embodiment of this invention where an intermediate support wire spring was fabricated by applying the wire spring bending device 500. Production of a main wire spring eliminates the use of said wire spring bending device 500.

There will now be described the apparatus of manufacturing a main wire spring according to the second embodiment of the invention by reference to FIGS. 24 and 25 respectively presenting the plan and side views of the apparatus. This embodiment is the same as the preceding one in that a straight wire is bent several times only once at different points at both ends while being rotated about its axis to provide a spring leg, each turn of which is set at a prescribed angle in a vertical plane relative to the straight portion of said wire.

The main wire spring leg fabricating device according to the second embodiment of this invention comprises, as shown in FIGS. 26 to 28, a base frame 801, wire rotating device 800 disposed at the center of the base frame 801 and a pair of wire bending devices 850 mounted on the base frame 801 on both sides of the wire rotating device 800.

The wire rotating device 800 has a bridging plate 802 provided, as shown in FIG. 26, crosswise on the base frame 801. A substrate 803 is fixed on the bridging plate 802. A pair of mutually facing upright support plates 804, 805 are erected, as shown in FIGS. 29 and 30, on the substrate 803. A wire rotating member 806 is rotatably disposed between the upper portions of the support plates 804, 805. The rotating member 806 is bored with a groove 807 extending along the entire length thereof. The support plates 804, 805 each have a pair of guide plates 808, 809 projecting upward on both sides of the groove 807. Fitted to one inner side wall of the groove 807 is a clamping member 810, to which a pair of shafts 811, 812 are fixed. Provided one atop another near the lower end portions of the shafts 811, 812 are a pair of support plates 813, 814 bored with poles, through which said shafts 811, 812 are introduced so as to be joined by said plates 813, 814 which are adjustably positioned by means of the corresponding nuts 815. Provided between the upper support plate 813 and wire rotating member 806 are a pair of coil springs 816, 817 wound about the aforesaid paired shafts 811, 812 respectively. The elastic force of said coil springs 816, 817 normally urges downward the clamping member 810 jointly with the support plates 813, 814 and shafts 811, 812, causing the underside of the clamping member 810 to be pressed against the inner bottom wall of the groove 807. Disposed below the lower support plate 814 is a drive pin 818 for lifting the clamping member 810 by sliding through the substrate 803. The vertical movement of the drive pin 818 is effected by a cylinder 819 and lever 820 (FIG. 30). The lever 820 is swingably fitted to a tongue-shaped member 821 projectively formed on the underside of the substrate 803. Provided on one side of the wire rotating member 806 is a minor gearwheel 822 which is rotated by a rack gear 825 through a pinion gear 824 disposed coaxially with a major gearwheel 823. The above-mentioned drive mechanism is fundamentally the same as in the first embodiment. The difference is that in the second embodiment, an engagement member 826 fitted to one end of the rack gear 825 engages a recess 829 formed between a pair of rails 828 laid on the upper surface of a drive plate 827; and that the linear movement of the drive plate 828 causes the rack gear 825 to be driven while being guided by the paired rails 828. The drive plate 828 is connected to the frame (later described) of one of the paired wire bending devices 850 (FIGS. 26 and 27) arranged parallel lengthwise on the base frame 801 on both sides of the wire rotating device 800 and makes a linear movement with the travel of the frame. Further, the drive plate 828 linearly moves in a direction guided by a guide roller 830 fitted to the upper surface of the substrate 803.

There will now be described by reference to FIGS. 26 to 28 and 33 to 36 only one of the wire bending devices 850 provided in pair with the same construction. A frame 851 is supported, as shown in FIG. 28, on the base frame 801 so as to move lengthwise thereof by means of a pair of rollers 852. Connected to the frame 851 are two drive cylinders 853 used with the paired wire bending devices 850. Fixed to the base frame 801 is a plate member 854, which is provided on the upper surface with a plurality of crosswise formed projecting ridges 855 arranged at a prescribed interval in a row extending lengthwise of the base frame 801 (namely, in the traveling direction of the frame 851). Rotatably fitted to the frame 851 is an arm 856, the outer end engaging portion 857 of which is selectively engaged with any of the projecting ridges 855 as shown in FIG. 36, thereby locating the frame 851 at a desired position.

The arm 856 is connected to a cylinder 858 fixed to the frame 851 so as to have the engaging portion 857 of said arm 856 released from any of the projecting ridges 855. Fixed to the frame 851 is a bearing 859 (FIG. 33) in which a rotatable shaft 860 is received. A pair of pins 861, 862 are projectively provided on the upper end face of the rotatable shaft 860 apart from the axial center thereof. A pinion gear 863 is connected to the lower end of the rotatable shaft 860 which projects downward from the bearing 859. Engaged with the pinion gear 863 is a rack gear 864 which is made to travel linearly across the base frame 801 by a cylinder 867 (FIG. 33) while being guided by upper and lower keep plates 865, 866 (FIG. 36). A pinch roller 868 (FIG. 33) rotatably supported on the frame 851 by a shaft 869 is pressed against the backside of the rack gear 864.

A wire 103 is clamped substantially at the center in the wire rotating device 800. Namely, the central part of the wire 103 is inserted into the groove 807 of the wire rotating member 806 so as to be clamped between the inner bottom wall of the groove 807 and the underside of the clamping member 810 by the elastic force of the coil springs 816, 817. Said clamping of the wire 103 is effected by operating the cylinder 819 (FIG. 31) to lift the drive pin 818, thereby moving upward the clamping member 810 jointly with the plate members 813, 814 and shafts 811, 812. In the wire rotating device 800, the drive of the rack gear 825 leads to the rotation of the wire rotating member 806 through the pinion gear 824, major gearwheel 823 and minor gearwheel 822, thereby causing the wire 103 to be rotated jointly with wire rotating member 806. The rack gear 825 is moved by the drive plate 827, when the wire bending devices 850 provided on both sides of the wire rotating device 800 travel toward each other. In the wire bending device 850, each end of the wire 103 is clamped between a pair of pins 861, 862. The operation of the cylinder 867 (FIG. 33) leads to the drive of the rack gear 864 and in consequence the rotation of the pinion gear 863 and rotatable shaft 860. The rotation of this shaft 860 causes each end of the wire 103 to be horizontally bent by the pins 861, 862. The operation of the cylinder 858 (FIG. 35) releases the outer end engaging portion 857 of the arm 856 from any of the projecting ridges 855 formed on the plate member 854. When, under this condition, the cylinder 853 (FIG. 28) is operated, each wire bending device 850 travels toward the other. When the outer end engaging portion 857 of the arm 856 engages the succeeding projecting ridge 855 after the travel of the wire bending device 850, then the fresh position of said device is determined. The wire is repeatedly bent at both ends by the paired wire bending device 850 in a horizontal plane while being rotated by the wire rotating device 800, providing a polygonal, for example, rectangular spring leg 103', namely, a wire spring at both ends of the wire 103.

I claim:

1. Wire spring-manufacturing apparatus comprising:

a. a wire rotating device for clamping a straight wire of prescribed length delivered from a wire feeder substantially at its center, and intermittently rotating said wire about its longitudinal axis;

b. a pair of wire bending devices disposed on opposite sides of said wire rotating device so as to intermittently approach each other toward the wire rotating device in timed relation to the rotation of the wire and horizontally bending both ends of the wire to form spring legs at each time of their mutual approach, said wire bending devices including:

i. a central shaft;

ii. a disc rotating about said central shaft;

iii. a projection formed on said disc sufficiently apart from the sidewall of said central shaft to allow the wire to be placed between said projection and the sidewall; and iv. means for rotating said disc about said central shaft horizontally to bend both ends of the wire to form spring legs;

c. drive means for intermittently driving said wire bending devices toward said wire rotating device, the axial rotation and bending of the wire being actuated by the movement toward said rotating device and pause of said wire bending devices; and d. a device for heat-treating spring legs formed at both ends of the wire.

2. The apparatus according to claim 1 which further comprises:

a. a wire feeder including a plurality of rails inclined downward toward said wire bending device, a spacer disposed above said rails at a larger interval than the diameter of the wire supplied, thereby preventing piling of said wire along said rails, and wire supplying means provided downstream of said spacer for delivering one wire after another to said wire spring-manufacturing apparatus; and b. means for applying wax to the bent wire springs including the spring legs forms at the end of the wire.

3. The apparatus according to claim 1 wherein said heat treating device comprises means for clamping both ends of a spring leg formed by bending the wire and heating means for introducing electric current across both ends of the spring leg for heat treatment.

4. A wire spring-manufacturing apparatus according to claim 1, wherein the wire-rotating device comprises a wire-rotating member provided with a U-shaped groove extending along the full length of said wire-rotating member to receive the wire supplied; a wire-clamping member disposed in the U-shaped groove and provided with wire-pressing means; and means for releasing, where required, the wire-pressing means of the wire-clamping member.

5. A wire spring-manufacturing apparatus according to claim 1, wherein the wire-rotating device comprises a wire-rotating member provided with a U-shaped groove extending along the full length of said wire-rotating member to receive the wire supplied and designed to rotate the wire about its axis; a gearwheel system integrally fitted to the wire-rotating member; and means to intermittently rotate the gearwheel system relative to the mutual approach of the paired wire-bending devices.

6. A wire spring-manufacturing apparatus according to claim 5, wherein the wire-rotating member comprises a rack gear and a stepped block member, against which one end of the rack gear is pressed, said stepped block member traveling with the wire-bending device, thereby shifting the rack gear and rotating the gearwheel system.

7. A wire spring-manufacturing apparatus according to claim 5, wherein the wire-rotating member comprises a rack gear and a stepwise-bent rail engaging one end of the rack gear; and the rack gear is moved with said one end thereof guided by the stepwise-bent rail traveling with the wire-bending device, thereby rotating the gearwheel system.

8. A wire spring-manufacturing apparatus according to claim 1, wherein the drive means comprises switching means movable with the central shaft; and a plurality of projections selectively contacting the switching means to render it conducting, thereby stopping the movement of the central shaft.

9. A wire spring-manufacturing apparatus according to claim 1, wherein the drive means comprises an arm bearing a concave engaging portion and traveling with the central shaft; and a plurality of projections selectively meshing with the concave engaging portion, thereby bringing the central shaft to rest at a prescribed position.

10. A wire spring-manufacturing apparatus according to claim 1, wherein the heat-treating device comprises means for clamping both ends of a spring leg formed by bending the wire and heating means to introduce electric current across both ends of the spring leg for heat treatment.

11. Wire spring-manufacturing apparatus comprising:

a. a wire feeder;

b. a wire rotating device for clamping a straight wire of prescribed length delivered from said wire feeder substantially at its center and intermittently rotating said wire about its longitudinal axis;

c. a pair of first wire bending devices disposed on opposite sides of said wire rotating device so as to intermittently approach each other toward said wire rotating device in timed relation to the rotation of the wire, thereby successively bending both ends of the wire in a horizontal plane to form spring legs at each time of their mutual approach, said first wire bending devices including;

i. a central shaft;

ii. a disc rotating about said central shaft;

iii. a projection formed on said disc sufficiently apart from the sidewall of the central shaft to allow the wire to be placed between said projection and the sidewall; and iv. means for rotating said disc about said central shaft horizontally to bend both ends of the wire to form spring legs;

d. drive means for intermittently drawing said first wire bending devices toward said wire rotating device, the axial rotation and bending of the wire being actuated by the movement toward said wire rotating device and pause of said first wire bending devices;

e. a device for heat-treating spring legs formed at both ends of the wire; and f. a pair of second wire bending devices for setting the spring legs in a prescribed position in a horizontal plane relative to the straight portion of the wire by further horizontally bending both ends of the wire at which the spring legs are formed.

12. A wire spring-manufacturing apparatus which comprises:

a. a wire feeder;

b. clamping means for clamping a straight wire of prescribed length which is delivered from said wire feeder at substantially the center of the wire;

c. rotating means for intermittently rotating a length of wire held by said clamping means about its axis;

d. at least two wire bending devices juxtapositioned with respect to said clamping and rotating means for horizontally bending both ends of a length of wire which may be retained in said clamping means;

e. movement means for intermittently moving said wire bending devices toward each other to bend both ends of a wire which may be held by said clamping means, said movement means moving said wire bending devices intermittently with respect to the rotation of a length of wire by said rotating means; and f. heat treating means for clamping both ends of a spring leg and introducing electric current thereacross to heat treat the spring.

* * * * *